US008494388B2

(12) United States Patent
Yoda

(10) Patent No.: US 8,494,388 B2
(45) Date of Patent: Jul. 23, 2013

(54) IMAGE FORMING APPARATUS WITH CONTROLLED HEATING WIDTH

(75) Inventor: Junya Yoda, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 290 days.

(21) Appl. No.: 12/943,223

(22) Filed: Nov. 10, 2010

(65) Prior Publication Data

US 2011/0123213 A1 May 26, 2011

(30) Foreign Application Priority Data

Nov. 26, 2009 (JP) ..... 2009-269011

(51) Int. Cl.
*G03G 15/20* (2006.01)

(52) U.S. Cl.
USPC ..... 399/69; 219/216

(58) Field of Classification Search
USPC ..... 399/69; 219/216
See application file for complete search history.

(56) References Cited

U.S. PATENT DOCUMENTS

| | | | | |
|---|---|---|---|---|
| 7,626,716 | B2 * | 12/2009 | Hayashi | 358/1.15 |
| 2006/0029411 | A1 * | 2/2006 | Ishii et al. | 399/67 |
| 2007/0014599 | A1 * | 1/2007 | Yasuda et al. | 399/328 |
| 2009/0175644 | A1 | 7/2009 | Nanjo et al. | |

FOREIGN PATENT DOCUMENTS

| | | |
|---|---|---|
| JP | 2000-75727 | 3/2000 |
| JP | 2005-321633 | 11/2005 |
| JP | 2005-342985 | 12/2005 |
| JP | 2006-145779 | 6/2006 |

* cited by examiner

*Primary Examiner* — G. M. Hyder
(74) *Attorney, Agent, or Firm* — Smith, Gambrell & Russell, LLP

(57) ABSTRACT

Provided is an image forming apparatus, including: a heating section; a coil that is opposed to the heating section, for heating the heating section; a core that has a circumferential surface covered with a magnetic shielding plate having different lengths in an axis direction in a plurality of steps according to a position in a circumferential direction; a rotary section for causing the core to rotate; a plurality of temperature sensing elements for sensing temperatures of the heating section; and a control section for controlling a heating width by controlling the rotary section to control a rotation angle of the core, setting the heating width corresponding to a size of a paper sheet at a start of a print job, and setting the heating width wider than at the start of the print job midway through the print job.

20 Claims, 11 Drawing Sheets

Fig.8

| HEATING WIDTH W3 (CORRESPONDING TO SHORT SIDE OF LETTER SIZE OR A4) | | | |
|---|---|---|---|
| TEMPERATURE OF NON-SHEET PASSING REGION (° C) | REMAINING NUMBER OF PRINTS FOR WIDENING HEATING WIDTH | | |
| | CARDBOARD | PLAIN PAPER | THIN PAPER |
| 130 | X 1 | Y 1 | Z 1 |
| 131 | X 2 | Y 2 | Z 2 |
| ⋮ | ⋮ | ⋮ | ⋮ |
| 169 | X 3 | Y 3 | Z 3 |
| HEATING WIDTH W2 (CORRESPONDING TO SHORT SIDE OF PAPER SHEET OF STATEMENT SIZE OR A5) | | | |
| TEMPERATURE OF NON-SHEET PASSING REGION (° C) | REMAINING NUMBER OF PRINTS FOR WIDENING HEATING WIDTH | | |
| | CARDBOARD | PLAIN PAPER | THIN PAPER |
| 130 | X 4 | Y 4 | Z 4 |
| 131 | X 5 | Y 5 | Z 5 |
| ⋮ | ⋮ | ⋮ | ⋮ |
| 169 | X 6 | Y 6 | Z 6 |
| ⋮ | | | |
| HEATING WIDTH W1 (CORRESPONDING TO SHORT SIDE OF POSTCARD, PHOTOGRAPHIC PAPER SHEET, OR A6) | | | |
| TEMPERATURE OF NON-SHEET PASSING REGION (° C) | REMAINING NUMBER OF PRINTS FOR WIDENING HEATING WIDTH | | |
| | CARDBOARD | PLAIN PAPER | THIN PAPER |
| 130 | X 7 | Y 7 | Z 7 |
| 131 | X 8 | Y 8 | Z 8 |
| ⋮ | ⋮ | ⋮ | ⋮ |
| 169 | X 9 | Y 9 | Z 9 |

Fig.11

| TEMPERATURE RISING RATE FOR NON-SHEET PASSING REGION (°C/SECOND) | | |
|---|---|---|
| PLAIN PAPER | | |
| HEATING WIDTH CHANGING PATTERN | HEATING WIDTH W3→HEATING WIDTH W4 | A1 |
| | HEATING WIDTH W2→HEATING WIDTH W4 | A2 |
| | HEATING WIDTH W1→HEATING WIDTH W4 | A3 |
| | HEATING WIDTH W2→HEATING WIDTH W3 | A4 |
| | ⋮ | ⋮ |
| | HEATING WIDTH W1→HEATING WIDTH W2 | A5 |
| THIN PAPER | | |
| HEATING WIDTH CHANGING PATTERN | HEATING WIDTH W3→HEATING WIDTH W4 | A6 |
| | HEATING WIDTH W2→HEATING WIDTH W4 | A7 |
| | HEATING WIDTH W1→HEATING WIDTH W4 | A8 |
| | HEATING WIDTH W2→HEATING WIDTH W3 | A9 |
| | ⋮ | ⋮ |
| | HEATING WIDTH W1→HEATING WIDTH W2 | A10 |
| CARDBOARD | | |
| HEATING WIDTH CHANGING PATTERN | HEATING WIDTH W3→HEATING WIDTH W4 | A11 |
| | HEATING WIDTH W2→HEATING WIDTH W4 | A12 |
| | HEATING WIDTH W1→HEATING WIDTH W4 | A13 |
| | HEATING WIDTH W2→HEATING WIDTH W3 | A14 |
| | ⋮ | ⋮ |
| | HEATING WIDTH W1→HEATING WIDTH W2 | A15 |

| PRINTING TIME PER SHEET (SECOND) | | |
|---|---|---|
| PAPER SHEET SIZE | TABLOID SIZE | T1 |
| | LETTERS SIZE (PORTRAIT) | T2 |
| | LETTERS SIZE (LANDSCAPE) | T3 |
| | ⋮ | ⋮ |
| | POSTCARD/PHOTOGRAPHIC PAPER SHEET | T4 |

IMAGE FORMING APPARATUS WITH CONTROLLED HEATING WIDTH

This application is based upon and claims the benefit of priority from the corresponding Japanese Patent Application No. 2009-269011 filed on Nov. 26, 2009, the entire contents of which are incorporated herein by reference.

BACKGROUND OF THE INVENTION

1. Field of the Invention

The present invention relates to an image forming apparatus which uses induction heating to heat a paper sheet onto which a toner image has been transferred and fix the toner image thereto, such as a multifunction peripheral, a copier, a printer, or a FAX machine.

2. Description of Related Art

Up to now, in some image forming apparatuses such as a multifunction peripheral, a formed toner image is transferred onto a paper sheet and fixed thereto by heat. A fixing device for fixing the toner image includes a rotary member such as a roller in order to perform heating while transporting the paper sheet. Some fixing devices fix the toner image by generating Joule heat by an eddy current due to a magnetic flux occurring from a coil or the like (i.e., by performing induction heating) and heating the rotary member to thereby heat the paper sheet. Here, it is necessary to keep heating the rotary member during printing because heat is taken away by a passing paper sheet from a portion (sheet passing region) of the rotary member heated by the induction heating which is in contact with the paper sheet. However, the temperature of a non-sheet passing region, which is not brought into contact with the paper sheet, keeps rising. For prevention of an excessive temperature rise in the non-sheet passing region or other such purpose, there is known a fixing device that adjusts a heating width while preventing a magnetic flux from reaching the non-sheet passing region of the rotary member.

For example, there is known a fixing device including: magnetic flux generating means for generating a magnetic flux; a heating element subjected to induction heating by the magnetic flux generated by the magnetic flux generating means; and an opposing core located so as to be opposed to the magnetic flux generating means across the heating element. The opposing core has a shape in which a clearance between an opposing portion that is opposed to a magnetic path of the magnetic flux and the heating element is smaller than a clearance between a non-opposing portion that is not opposed to the magnetic path and the heating element. The opposing portion of the opposing core is formed of a convex portion that protrudes from the non-opposing portion, and a length in a longitudinal direction of the convex portion corresponds to a width of a size of a recording medium that can be passed. A magnetic shielding member for shielding against the magnetic flux flowing in the non-sheet passing region is disposed to the opposing core so as to be opposed to the non-sheet passing region of the heating element.

There exists an image forming apparatus that changes the heating width according to the size of the paper sheet. However, in a case where the heating width remains changed until a print job is completed, the temperature drops in the non-sheet passing region of the rotary member. In this case, at the end of the print job, the temperature of the non-sheet passing region may become lower than a fixation control temperature that is necessary for fusing toner and is to be maintained in performing fixation. Therefore, when a new print job is executed by using a paper sheet having a larger size (for example, A3 size) than a paper sheet used for the preceding print job (for example, postcard printing), it is necessary to heat the entire sheet passing region of the paper sheet used for the new print job and raise a temperature thereof. This leads to a problem that a user needs to wait because of being unable to execute a print job immediately after completion of the preceding print job.

Further, there is a method of controlling the heating width according to a paper sheet size when the temperature of the non-sheet passing region rises during the printing. According to this method, it is true that the temperature of the non-sheet passing region may be prevented from becoming lower than the fixation control temperature at completion of a print job and that a new print job may be executed immediately after the completion of the preceding print job. However, under such control, the non-sheet passing region that does not need to be heated is actively heated, which poses a problem of wasteful power consumption.

Those fixing devices can perform heating control according to a region of the paper sheet. However, it is impossible to solve the problem that the temperature of the non-sheet passing region becomes lower at the completion of a print job or the problem that a new print job cannot be executed immediately after the completion of the preceding print job and that the user needs to wait. Further, it is also impossible to solve the problem of wasteful power consumption due to the heating of the non-sheet passing region that does not need to be heated.

SUMMARY OF THE INVENTION

In view of the above-mentioned problems of the conventional technologies, an object of the present invention is to provide an image forming apparatus that performs fixation by induction heating, in which printing on a paper sheet having any size can be performed immediately after completion of a print job and needless heating of a non-sheet passing region is avoided to thereby eliminate wasteful power consumption.

In order to achieve the above-mentioned object, an image forming apparatus according to an aspect of the present invention includes: a sheet feeding section for receiving a paper sheet used for printing; an image forming section for forming a toner image; a heating section comprising a rotary member that is brought into contact with the paper sheet, for fixation of the toner image; a coil that is opposed to the heating section and is wound around the rotary member in an axis direction thereof, for heating the heating section by induction heating; a core that is opposed to the heating section, forms a magnetic path between the coil and the heating section, and has a circumferential surface covered with a magnetic shielding plate, the circumferential surface covered with the magnetic shielding plate having different lengths in the axis direction in a plurality of steps according to a position in a circumferential direction; a rotary section for causing the core to rotate; a plurality of temperature sensing elements for sensing temperatures of the heating section according to a heating width; and a control section for controlling power to be supplied to the coil based on an output from each of the plurality of temperature sensing elements, recognizing a size of the paper sheet used for the printing, controlling the heating width in the heating section by controlling the rotary section to control a rotation angle of the core, controlling the rotary section to set the heating width corresponding to the size of the paper sheet at a start of a print job, and causing the heating section to be heated by controlling the rotary section to set the heating width wider than at the start of the print job midway through the print job.

According to this aspect, it is possible to eliminate the wasteful power consumption due to the needless heating of the non-sheet passing region. Further, even when the size of the paper sheet used for the subsequent print job after the completion of the print job is larger than the size of the paper sheet used for the preceding print job, a user does not need to wait until an entire sheet passing region of the paper sheet used for the subsequent print job is heated to a fixation control temperature.

Further features and advantages of the present invention will become apparent from the description of embodiments given below.

BRIEF DESCRIPTION OF THE DRAWINGS

FIG. 8 is an explanatory diagram illustrating an example of data for heating used for heating a non-sheet passing region during a print job executed on the multifunction peripheral according to the first embodiment.

FIG. 11 is an explanatory diagram illustrating an example of measurement data on a temperature rising rate obtained from a multifunction peripheral according to the second embodiment.

DETAILED DESCRIPTION OF PREFERRED EMBODIMENTS

First Embodiment

Hereinafter, with reference to FIGS. 1 to 9, a first embodiment of the present invention is described by taking a multifunction peripheral 100 (corresponding to an image forming apparatus) as an example. However, components, layouts, and other such elements described in each embodiment do not limit the scope of the invention and are mere examples used for the description.

(Schematic Structure of Multifunction Peripheral 100)

Figure 1:
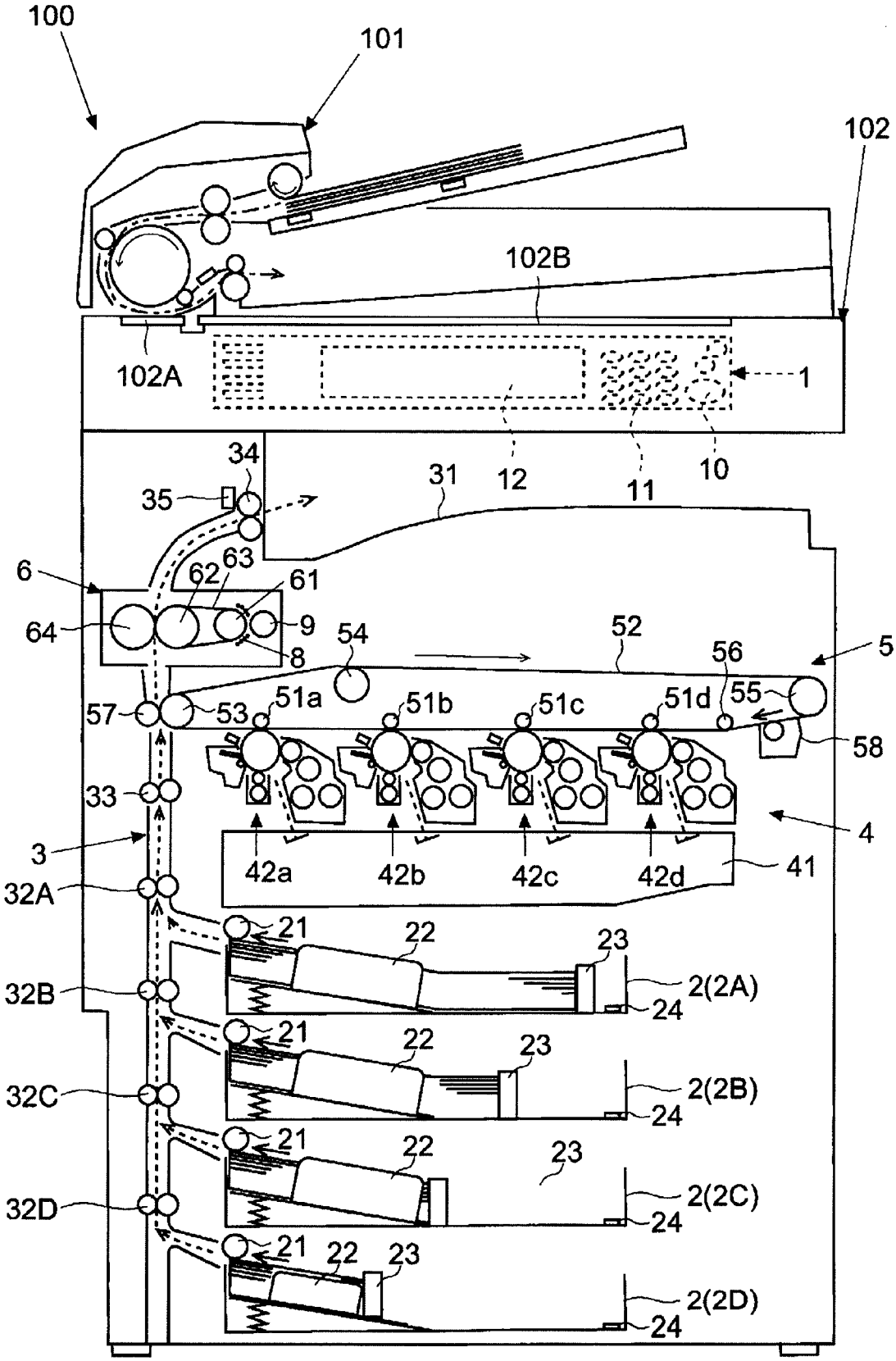
FIG. 1 is a schematic sectional view illustrating a schematic structure of a multifunction peripheral according to a first embodiment of the present invention.
Figure 2:
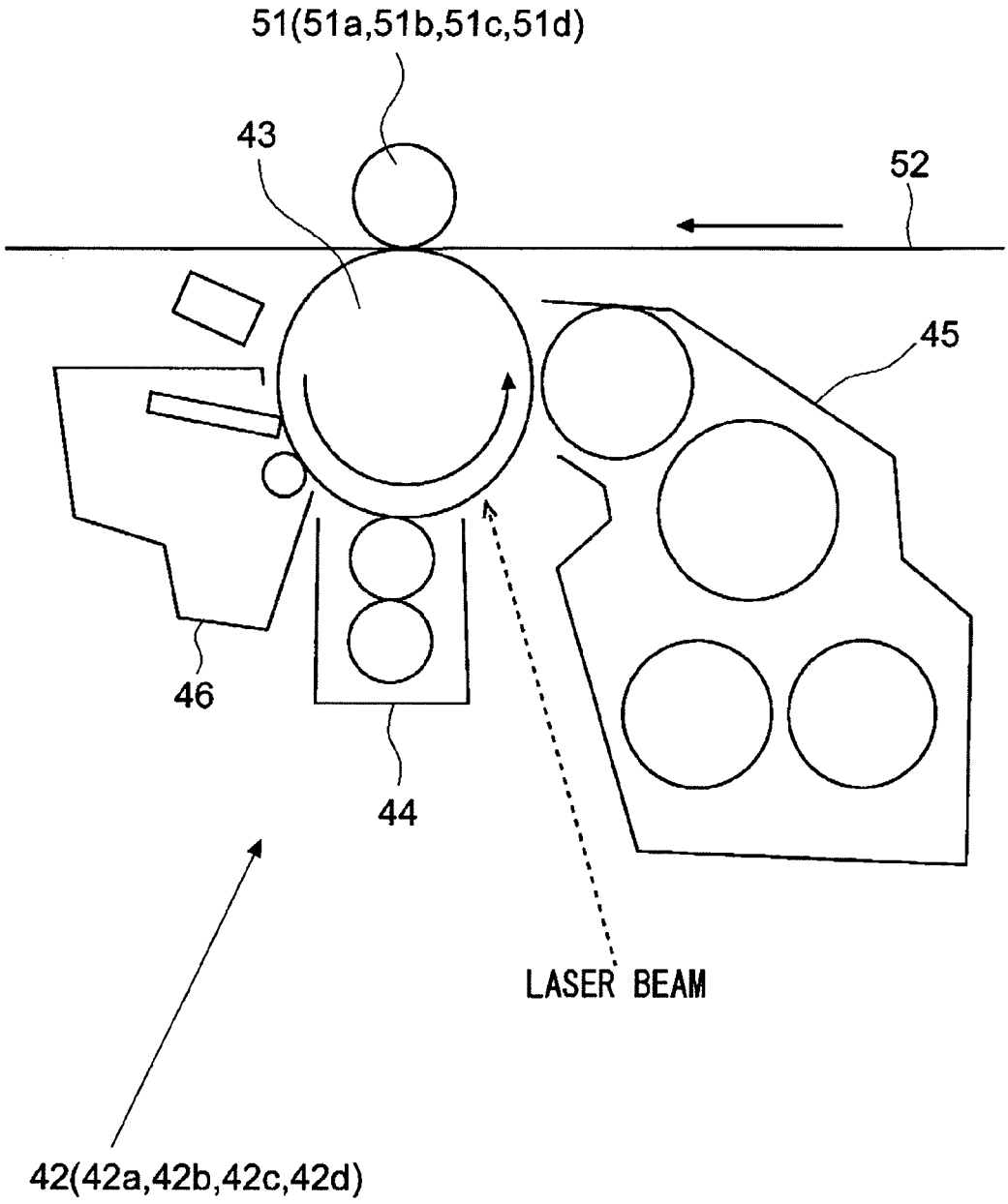
FIG. 2 is an enlarged schematic sectional view of one image forming unit according to the first embodiment.

First, FIGS. 1 and 2 are used to describe an outline of the multifunction peripheral 100 according to the first embodiment of the present invention. FIG. 1 is a schematic sectional view illustrating the schematic structure of the multifunction peripheral 100 according to the first embodiment of the present invention. FIG. 2 is an enlarged schematic sectional view of one image forming unit 42 according to the first embodiment of the present invention.

First, an document transporting apparatus 101 for automatically and successively transporting documents to a reading position one by one at a time of copying is mounted on a top part of the multifunction peripheral 100. An image reading section 102 is provided below the document transporting apparatus 101. Further, the document transporting apparatus 101 is attached to the image reading section 102 so as to freely open and close in a vertical direction with the back of the drawing sheet of FIG. 1 as a fulcrum. This allows the document transporting apparatus 101 to also function as a cover that holds down the document from above.

Disposed on an upper surface of the image reading section 102 are a contact glass 102A for reading transported documents and a contact glass 102B for reading a placed document on which each of documents is placed and read. Disposed inside the image reading section 102 are a lamp, a mirror, a lens, an image sensor, and the like (not shown). The image sensor reads an document based on reflected light from the document passing through the contact glass 102A for reading transported documents or the document placed on the contact glass 102B for reading a placed document. Then, the image sensor converts the reflected light into an analog electrical signal according to an image density. The image reading section 102 performs quantization to obtain image data.

Further, as indicated by the broken lines of FIG. 1, an operation panel 1 (corresponding to an operation input section) is provided to a front surface on the upper portion of the multifunction peripheral 100. The operation panel 1 includes a start key 10 for instructing execution of copying or the like after the various settings. The operation panel 1 further includes a numeric keypad 11 for inputting numerals such as the number of copies to be printed. The operation panel 1 further includes a liquid crystal display section 12 for displaying a menu and a key for performing settings on the multifunction peripheral 100 and giving an operation instruction thereto. The liquid crystal display section 12 has a touch panel system. A user can perform settings on the multifunction peripheral 100 and giving an operation instruction thereto by depressing a key displayed on the liquid crystal display section 12. For example, through the operation panel 1, the user can specify a size and a type of a paper sheet to be used.

Further, the multifunction peripheral 100 includes, from a bottom part thereof, sheet feeding sections 2A to 2D, a transport path 3, an image forming section 4, an intermediate transferring section 5, and a fixing device 6.

The sheet feeding sections 2A, 2B, 2C, and 2D from a top stage to a bottom stage in a lower part of the multifunction peripheral 100 of FIG. 1 (hereinafter, also referred to simply as "sheet feeding sections 2") receive a plurality of paper sheets used for printing having different sizes (for example, letter size, legal size, tabloid size, A-series paper size such as A4, and B-series paper size such as B4) and different kinds of paper (for example, plain paper such as copy paper, recycled paper, thin paper, cardboard, and OHP sheet).

For example, the sheet feeding section 2A at the top stage receives paper sheets of a tabloid size (11×17 inches) or A3 paper sheets that are stacked with a paper sheet transport direction coinciding with a long-side direction of the paper sheet. The sheet feeding section 2B at the second stage from the top receives paper sheets of a letter size (8.5×11 inches) or A4 paper sheets that are stacked with the paper sheet transport direction coinciding with the long-side direction of the paper sheet. The sheet feeding section 2C at the third stage from the top receives paper sheets of a statement size (5.5×8.5 inches) or A5 paper sheets that are stacked with the paper sheet transport direction coinciding with the long-side direction of the paper sheet. The sheet feeding section 2D at the bottom stage receives postcards, photographic paper sheets, or A6 paper sheets that are stacked with the paper sheet transport direction coinciding with the long-side direction. Note that, the sheet feeding sections 2 each have the same structure, and hence the same components are denoted by the same reference numerals.

The sheet feeding sections 2 each include a sheet feeding roller 21 that is driven to rotate by a motor for sheet feeding, and send the paper sheets to the transport path 3 one by one at a time of printing. The sheet feeding sections 2 each further include therein two kinds of regulating guides, that is, regulating guides 22 for regulating the paper sheets so as to sandwich the paper sheets in a direction perpendicular to the paper sheet transport direction and a trailing edge regulating guide 23 for regulating the paper sheets by being brought into contact with trailing edges of the paper sheets. The regulating guides 22 are provided in pairs (only one of which is visible in FIG. 1), and slide in synchronization with each other. In a case of actually regulating a paper sheet position, the regulating guides 22 are caused to slide so as to sandwich the paper sheet. As a result, the paper sheet is regulated so that the center of a width direction of the transport path 3 (direction perpendicular to the paper sheet transport direction and direction perpendicular to the drawing sheet of FIG. 1) coincides with a center axis of the paper sheet (center sheet passing). The trailing edge regulating guide 23 is also caused to slide so as to regulate a trailing edge of the paper sheet.

Further, the sheet feeding sections 2 each include a paper sheet size sensor 24 for detecting the size of the stacked paper sheets. For example, the paper sheet size sensor 24 includes a variable resistor (not shown) connected to the trailing edge regulating guide 23 whose resistance value changes according to a slide position and a variable resistor (not shown) connected to the regulating guides 22 whose resistance value changes according to a slide position. Therefore, the paper sheet size sensor 24 outputs a different voltage according to the positions of the respective regulating guides. Note that, the paper sheet size sensor 24 may include a plurality of optical sensors for detecting the positions of the respective regulating guides as long as the paper sheet size sensor 24 can recognize the size of the stacked paper sheets.

Subsequently, the transport path 3 transports the paper sheet to lead the paper sheet from the sheet feeding section 2 to a delivery tray 31 via the intermediate transferring section and the fixing device 6. Provided to the transport path 3 are a plurality of transport roller pairs 32A, 32B, 32C, and 32D from the top and a guide. Further provided to the transport path 3 is, for example, a registration roller pair 33 for causing the transported paper sheet to stand by before the transfer and sending out the paper sheet at a suitable timing. Further provided to a downstream side of the fixing device 6 is a delivery roller pair 34 for delivering the paper sheet toward the delivery tray 31. Note that, a paper sheet sensor 35 (for example, an optical sensor is used) for detecting the delivery of the paper sheet is provided in the vicinity of the delivery roller pair 34.

As illustrated in FIGS. 1 and 2, the multifunction peripheral 100 includes the image forming section 4 for forming a toner image based on the image data. Specifically, the image forming section 4 includes an exposure device 41 and the image forming units 42 corresponding to four colors including an image forming unit 42*a* for forming a black image, an image forming unit 42*b* for forming a yellow image, an image forming unit 42*c* for forming a cyan image, and an image forming unit 42*d* for forming a magenta image.

Here, FIGS. 1 and 2 are referenced to describe the image forming units 42*a* to 42*d*. Note that, the respective image forming units 42*a* to 42*d* basically have the same structure except that the color of the toner image to be formed is different thereamong. Thus, the structure of the image forming unit 42 is described in the following by omitting the symbols of a, b, c, and d unless otherwise specified.

A photosensitive drum 43 is supported so as to be able to rotate, receives a driving force from a motor (not shown), is caused to rotate, and bears the toner image on a circumferential surface thereof. The photosensitive drum 43 is driven to rotate counterclockwise with respect to the drawing sheet of FIG. 2 at a predetermined speed. A charging device 44 charges the photosensitive drum 43 to a constant potential. Note that, the charging device 44 may be of a corona discharge type or a type of using a roller, a brush, or the like to charge the photosensitive drum 43.

The exposure device 41 provided below the image forming unit 42 is a laser unit for outputting a laser beam. The exposure device 41 outputs the laser beam (indicated by the broken line) being an optical signal to the photosensitive drum 43 based on an image signal obtained by color separation, and performs scanning exposure on the charged photosensitive drum 43 to thereby form an electrostatic latent image. Note that, an array of LEDs or the like may be used as the exposure device 41. A developing device 45 receives a developer including toner (black developer for the image forming unit 42*a*, yellow developer for the image forming unit 42*b*, cyan developer for the image forming unit 42*c*, and magenta developer for the image forming unit 42*d*). The developing device 45 supplies toner to the photosensitive drum 43. As a result, the electrostatic latent image on the photosensitive drum 43 is developed. A cleaning device 46 scrapes off and removes stains such as residual toner left after the transfer.

The description is continued referring back to FIG. 1. The intermediate transferring section 5 has toner images primarily transferred by the photosensitive drum 43 and secondarily transfers the toner images onto the paper sheet. The intermediate transferring section 5 includes primary transfer rollers 51*a* to 51*d*, an intermediate transferring belt 52, a driving roller 53, driven rollers 54 to 56, a secondary transfer roller 57, and a belt cleaning device 58. The primary transfer rollers 51*a* to 51*d* respectively sandwich the intermediate transferring belt 52 having an endless belt shape with the corresponding photosensitive drums 43.

The intermediate transferring belt 52 is formed of a dielectric resin or the like, and stretched around the driving roller 53 and the driven rollers 54 to 56. The intermediate transferring belt 52 is driven to revolve clockwise with respect to the drawing sheet of FIG. 1 by the driving roller 53 connected to a driving mechanism (not shown) such as a motor. Further, the driving roller 53 and the secondary transfer roller 57 sandwich the intermediate transferring belt 52 and form a secondary transfer nip. In order to transfer the toner image, a predetermined voltage is applied to each of the primary transfer rollers 51*a* to 51*d*. The toner images (of the respective colors of black, yellow, cyan, and magenta) formed by the respective image forming units 42 are primarily transferred onto the intermediate transferring belt 52 in order while being overlaid one on another without misregistration. When the overlaid toner images of the respective colors enter the secondary transfer nip, the paper sheet enters simultaneously. A predetermined voltage is applied to the secondary transfer roller 57, and the toner images are secondarily transferred onto the paper sheet. Note that, the belt cleaning device 58 removes and collects the residual toner from the surface of the intermediate transferring belt 52 after the secondary transfer.

The fixing device 6 is located on the downstream of the intermediate transferring section 5 in the paper sheet transport direction. The fixing device 6 heats and pressurizes the toner image obtained by the secondary transfer and fixes the toner image to the paper sheet. The paper sheet that has been subjected to the fixation is a delivered to the delivery tray 31, thereby completing image formation. Note that, details of the fixing device 6 are described later.

(Hardware Configuration of Multifunction Peripheral 100)

Figure 3:
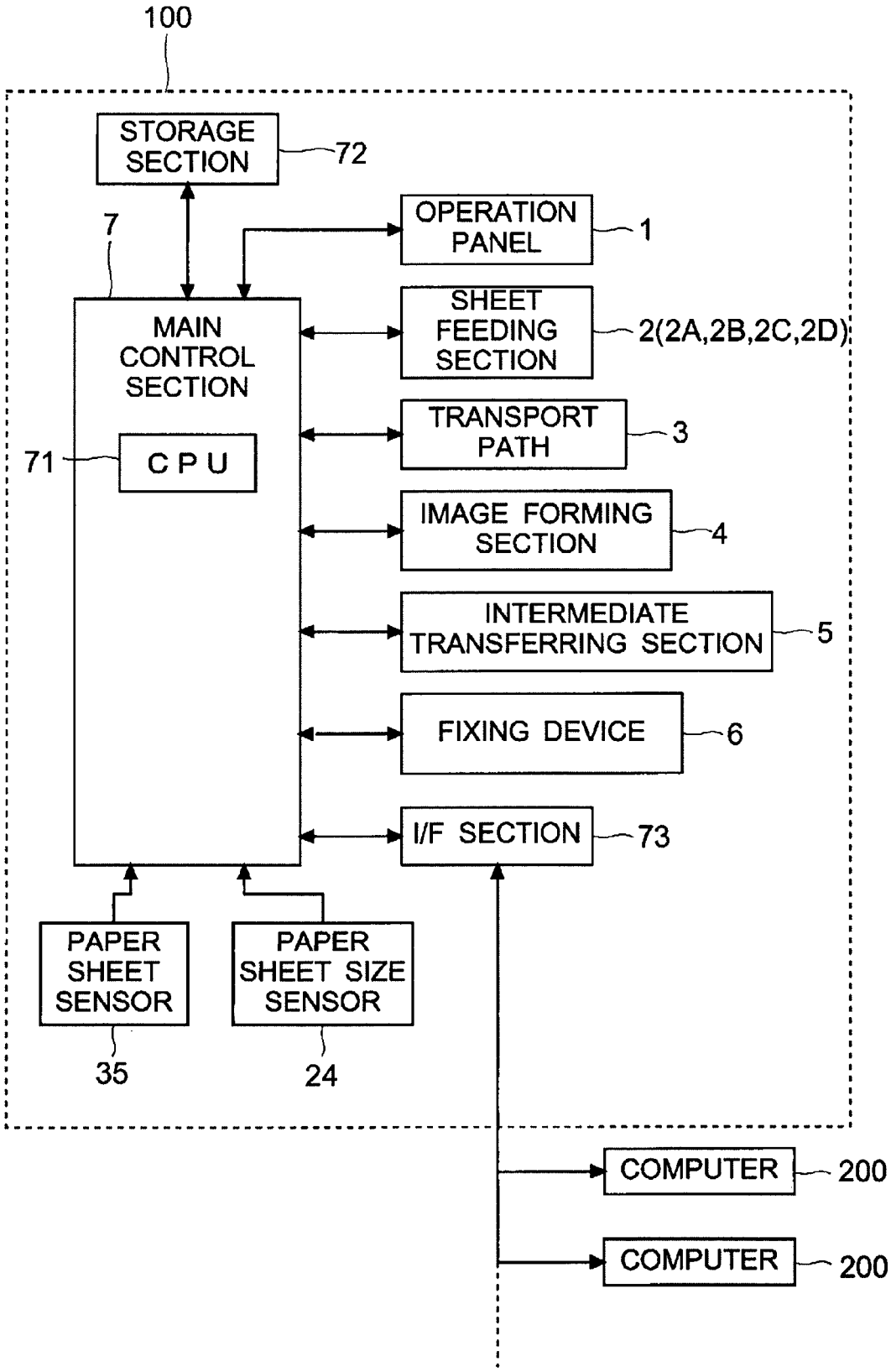
FIG. 3 is a block diagram illustrating an example of a hardware configuration of the multifunction peripheral according to the first embodiment.

Next, FIG. 3 is referenced to describe a hardware configuration of the multifunction peripheral 100 according to the first embodiment of the present invention. FIG. 3 is a block diagram illustrating an example of the hardware configuration of the multifunction peripheral 100 according to the first embodiment of the present invention.

As illustrated in FIG. 3, the multifunction peripheral 100 according to this embodiment includes therein a main control section 7 (corresponding to a control section). The main control section 7 controls respective components of the multifunction peripheral 100. For example, the main control section 7 includes a CPU 71 and other electronic circuits and elements. Further, the main control section 7 is connected to a storage section 72. The CPU 71 is a central processing unit for performing control of the respective components of the multifunction peripheral 100 and computation based on a control program stored in and loaded into the storage section 72. The storage section 72 is configured to have a combination of nonvolatile storage devices and volatile storage devices such as a ROM, a RAM, a flash ROM, and an HDD. For example, the storage section 72 stores a control program for the multifunction peripheral 100 and various kinds of data including control data.

Note that, the main control section 7 may be divided into a plurality of kinds of sections in terms of the function, for example, a main control section for performing overall control and an image processing and an engine control section for controlling on/off states and the like of the fixing device 6, motors that control various rotary members, and the like. However, as illustrated in FIG. 3, the main control section 7 is described here as a collective component.

Figure 6:
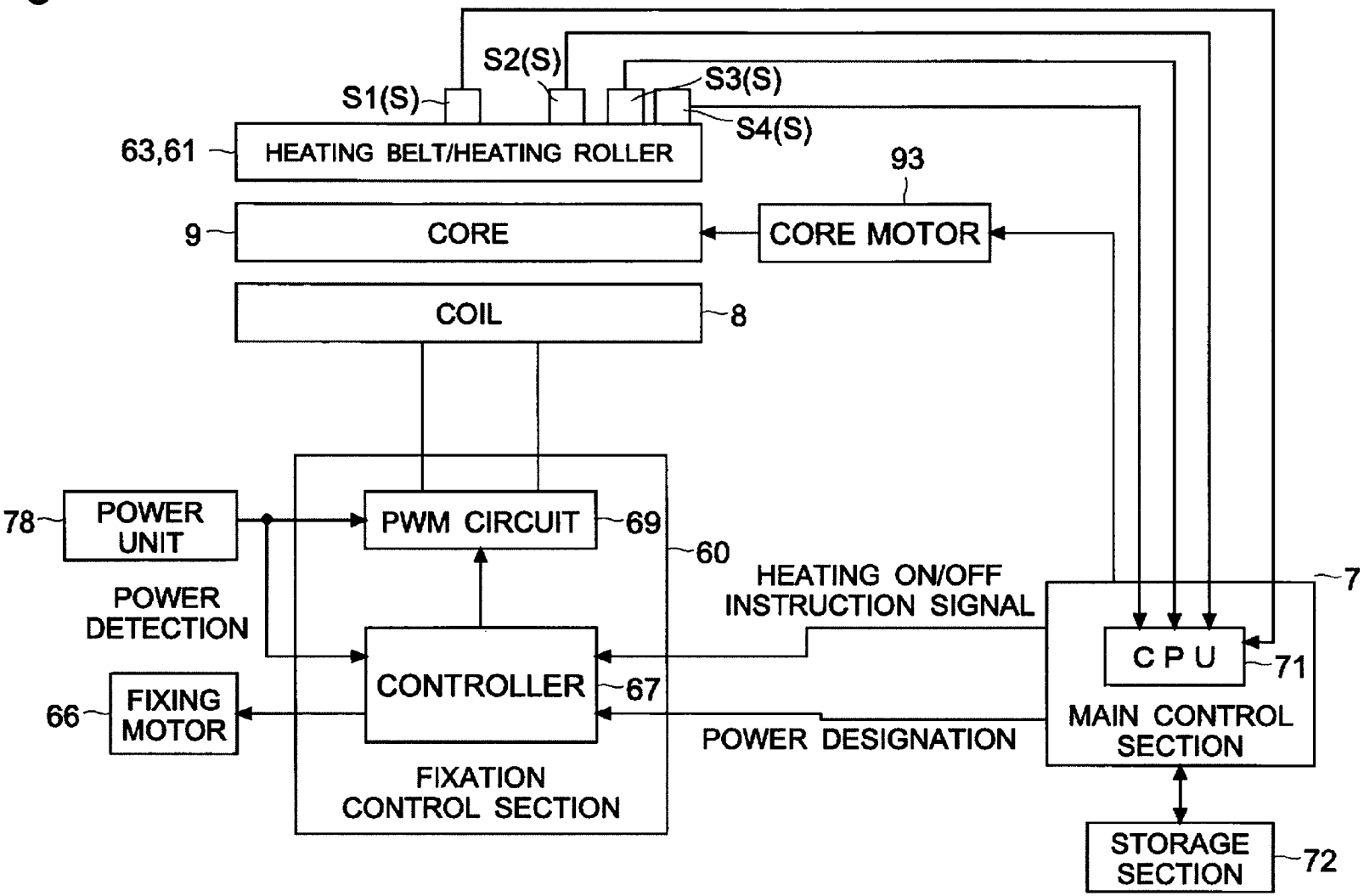
FIG. 6 is an explanatory diagram illustrating an example of a hardware configuration regarding heating control performed on the fixing device according to the first embodiment.

Then, the main control section 7 is connected to the sheet feeding sections 2, the transport path 3, the image forming section 4, the intermediate transferring section 5, the fixing device 6, and the like, and controls operations of the respective components so that the image formation can be performed appropriately based on the control program and the data in the storage section 72. Note that, the main control section 7 according to this embodiment of the present invention controls power to be supplied to a coil 8, recognizes a paper sheet size to be used for printing, and controls a rotary section (core motor 93) to thereby control a rotation angle of a core 9 in order to maintain a temperature of a sheet passing region of the rotary member (heating belt 63) which is brought into contact with the paper sheet at a fixation control temperature that is a temperature level necessary for fixation based on an output from a temperature sensing element (temperature sensor S as illustrated in FIG. 6).

Further, the main control section 7 is connected via an I/F section 73 (corresponding to a communication section) to computers 200 (such as personal computers) and the like serving as a transmission source of the image data based on which printing is to be performed. For example, driver software for using the multifunction peripheral 100 is installed in each of the computers 200. Then, the multifunction peripheral 100 can have a plurality of computers 200 communicably connected thereto via a network. Further, the multifunction peripheral 100 can have the computers 200 directly connected to the I/F section 73 via cables or the like. The main control section 7 transmits image data obtained by performing an image processing on the image data received from the computer 200 to the exposure device 41 of the image forming section 4, and the exposure device 41 forms an electrostatic latent image on the photosensitive drum 43.

Further, the paper sheet size sensors 24 inside the respective sheet feeding sections 2 are connected to the main control section 7 (for example, CPU 71). Then, the main control section 7 recognizes the sizes of the paper sheets received in the respective sheet feeding sections 2 based on voltages output from the paper sheet size sensors 24. Further, the operation panel 1 is connected to the main control section 7, and an input to the operation panel 1 causes the size of the paper sheet selected by the user to be conveyed to the main control section 7. Further, the computer 200 may designate the paper sheet to be used for printing by sending setting data for specifying the paper sheet to be used for printing to the main control section 7 in synchronization with the transmission of the image data. The main control section 7 checks the sizes of the paper sheets received in the respective sheet feeding sections 2, and causes the sheet feeding section 2 receiving the paper sheets of the designated size to perform sheet feeding at the time of printing. As described above, according to the multifunction peripheral 100 of this embodiment, it is possible to perform printing on the paper sheets of various sizes. In addition, the paper sheet sensor 35 is connected to the main control section 7. The main control section 7 detects the delivery of the paper sheet from the delivery roller pair 34 based on the output from the paper sheet sensor 35, and recognizes completion of the printing (delivery) of one page.

(Structure of Fixing Device 6)

Figure 4A:
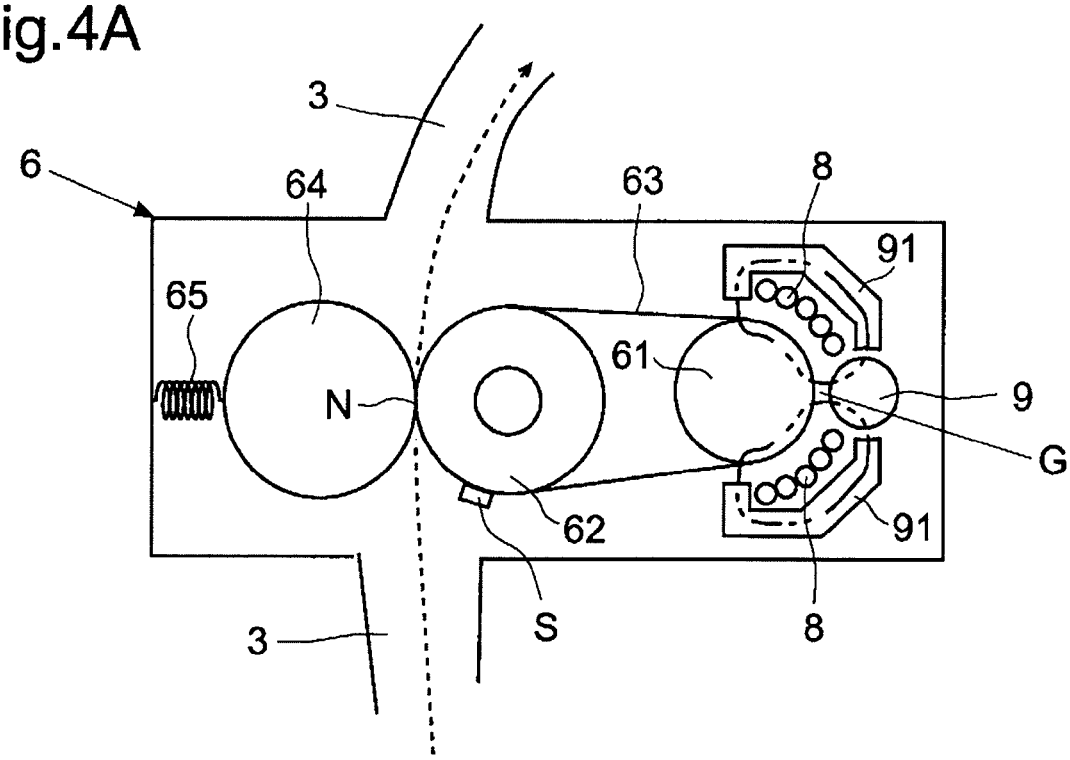
FIG. 4A is a schematic sectional view of an example of a fixing device according to the first embodiment when viewed from a front side.
Figure 4B:
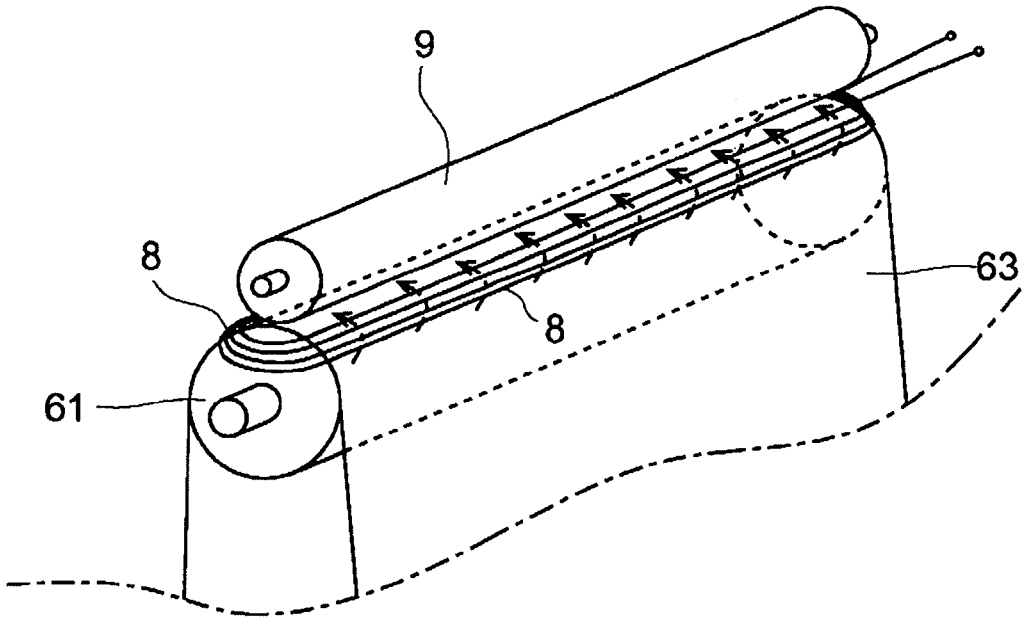
FIG. 4B is a perspective view illustrating an example of a structure around a heating roller.

Next, FIGS. 4A and 4B are referenced to describe an example of a structure of the fixing device 6 according to the first embodiment of the present invention. FIG. 4A is a schematic sectional view of an example of the fixing device 6 according to the first embodiment of the present invention when viewed from a front side, and FIG. 4B is a perspective view illustrating an example of a structure around a heating roller 61.

As illustrated in FIG. 4A, the fixing device 6 of this embodiment includes therein: a heating section that includes the heating roller 61 (corresponding to a heating section), a fixing roller 62 (corresponding to the heating section), and the heating belt 63 (corresponding to a rotary member of the heating section) serving as the rotary member brought into contact with the paper sheet in order to fix the toner image; the coil 8; the core 9; an external core 91; and a pressure roller 64. Note that, the heating roller 61, the fixing roller 62, the heating belt 63, the core 9, and the pressure roller 64 are supported so as to be able to rotate with axis directions parallel with one another.

The heating roller 61 (made of, for example, iron) is heated by the coil 8 by induction heating in order to fix the toner image. The axis direction of the heating roller 61 is set as a direction perpendicular to the drawing sheet of FIG. 4A (direction perpendicular to the paper sheet transport direction, that is, width direction of the paper sheet). The fixing roller 62 having an elastic circumferential surface formed of, for example, a sponge-like material is provided so as to be opposed to the heating roller 61. Further, the heating belt 63 is stretched around the heating roller 61 and the fixing roller 62. The heating belt 63 has a function of transmitting heat to the fixing roller 62. The heating belt 63 is a rotary member that is heated by the coil 8 by the induction heating for fixation. The heating belt 63 is made of a thinly-stretched sheet metal (for example, nickel) and has an endless belt shape.

Then, the pressure roller 64 is provided so as to be opposed to the fixing roller 62. The pressure roller 64 is formed of, for example, a sponge-like material. The pressure roller 64 is biased by a biasing member 65 (for example, spring) in a direction toward the fixing roller 62 while sandwiching the heating belt 63 with the fixing roller 62. As a result, the pressure roller 64 is brought into a press contact against the heating belt 63 to thereby form a fixing nip N.

For example, a driving force of a fixing motor 66 provided to the fixing device 6 as illustrated in FIG. 6 is transmitted to the fixing roller 62, thereby causing the fixing roller 62 to rotate. The rotation of the fixing roller 62 causes the heating belt 63 to rotate and accordingly causes the heating roller 61 to rotate. Further, the pressure roller 64 is also caused to rotate in synchronization with the rotation of the fixing roller 62. While the fixing roller 62 and the like are caused to rotate, when the paper sheet onto which the toner image has been transferred is caused to enter the fixing nip N and the paper sheet is transported and caused to pass therethrough, the toner image is heated and pressurized, and then fixed to the paper sheet (the paper sheet transport direction is indicated by the broken line of FIG. 4A).

Next described is a structure for heating the heating belt 63 and the heating roller 61. As illustrated in FIG. 4A, the coil 8 and the core 9 are provided so as to be opposed to the circumferential surface of the heating roller 61 on the opposite side of a side on which the fixing roller 62 is provided. As illustrated in FIGS. 4A and 4B, the coil 8 is opposed to the heating section (heating belt 63 and the like), is wound around the rotary member (heating belt 63) along the axis direction, and heats the heating section by the induction heating. Further, the coil 8 is wound around the heating roller 61 along the axis direction so as to avoid a gap G between the heating roller 61 and the core 9, thereby exhibiting a shape of the letter "V" in which the two strokes are separated when sectioned along a plane orthogonal to the axis of the heating roller 61.

Figure 5:
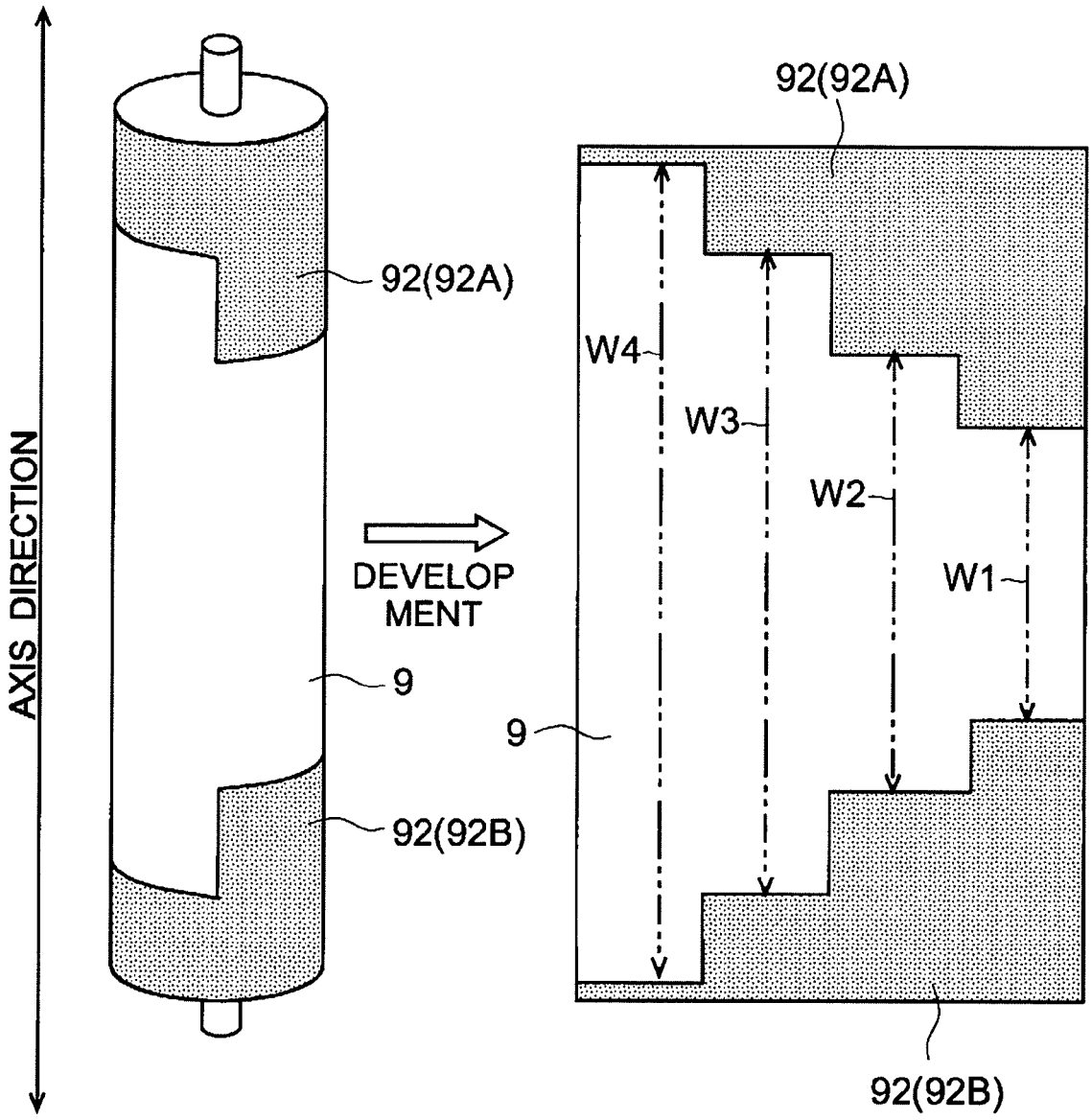
FIG. 5 is an explanatory diagram illustrating an example of a core of the fixing device according to the first embodiment.

The core 9 is opposed to the heating section including the heating roller 61, forms a magnetic path between the coil 8 and the heating section, and has the circumferential surface covered with magnetic shielding plates 92A and 92B (hereinafter, also referred to collectively as "magnetic shielding plates 92") that block magnetism. Further, as illustrated in FIG. 5, in order to vary a heating width W for heating the heating section, the surface of the core 9 covered with the magnetic shielding plates 92 has different lengths in the axis direction in a plurality of steps according to the position in the circumferential direction. Further, the core 9 has the axis direction parallel with that of the heating roller 61. Then, as illustrated in FIG. 4B, the coil 8 is formed of one conductor wire, and both ends of the conductor wire are set as terminals to which an A/C voltage is applied (described later in detail).

When the A/C voltage is applied to the coil 8, a current is caused to flow in the coil 8, and a magnetic field is formed, for example, as indicated by the dash-dot-dot lines of FIGS. 4A and 4B. The external core 91 is formed of, for example, ferrite, and forms a magnetic path, thereby preventing diffusion of a magnetic flux. Then, the magnetic flux penetrates the heating belt 63 and the heating roller 61 to generate an eddy current. The heating belt 63 and the heating roller 61 are heated (subjected to the induction heating) by Joule heat generated by the eddy current. When the fixing roller 62 and the like are caused to rotate during the induction heating, the entirety of the heating roller 61 and the heating belt 63 are heated. Further, the heat is transmitted to the fixing roller 62 by the heating belt 63. In addition, the heat is also transmitted to the pressure roller 64. The fixing device 6 is thus heated. At the time of fixation, the fixing roller 62 and the like are heated up to, for example, approximately 170° C.

Note that, the fixing device 6 of this embodiment includes a plurality of temperature sensors S (corresponding to the temperature sensing element). The respective temperature sensors S are provided in contact with the heating belt 63 in the vicinity of an entrance portion for the paper sheet (non-contact type is applicable). In the fixing device 6 of this embodiment, it is possible to vary the heating width W (length in the axis direction across which the heating belt 63 and the heating roller 61 are heated) for heating the heating belt 63 and the like (described later in detail). Thus, the plurality of temperature sensors S that are provided include ones for measuring the temperatures at the end portions of each heating width W and one for measuring the temperature at the center portion in the axis direction of the heating belt 63. That is, the plurality of temperature sensors S are provided in order to sense the temperatures of the heating section according to the heating width W. Note that, the temperature sensors S are arrayed along the axis direction of the fixing roller 62, and hence only one provided in front is illustrated in FIG. 4A. The respective temperature sensors S may have the same structure, for example, including a thermistor and having an output voltage varied according to the temperature of the heating belt 63.

(Core 9 and Magnetic Shielding Plates 92*a* and 92*b*)

Next, FIG. 5 is referenced to describe an example of the core 9 of the fixing device 6 according to the first embodiment of the present invention. FIG. 5 is an explanatory diagram illustrating an example of the core 9 of the fixing device 6 according to the first embodiment of the present invention.

On the multifunction peripheral 100 of this embodiment, printing may be performed by using various sizes of paper sheet. Further on the multifunction peripheral 100 of this embodiment, the center sheet passing is performed so that the center axis of the paper sheet and the center of the transport path 3 in the width direction coincide with each other in the fixing device 6 and the like. For example, in a case where the multifunction peripheral 100 of this embodiment can print the paper sheet of A3 size at maximum, the lengths in the axis direction of the heating roller 61, the fixing roller 62, the pressure roller 64, the heating belt 63, and the like are set as a larger size than a short side of the paper sheet of A3 size (approximately 30 cm).

In a case where the printing is continuously performed on the paper sheets, heat is taken away from the portion that is in contact with the paper sheet, and hence it is necessary to heat the heating roller 61 to thereby prevent the temperatures of the heating belt 63 and the like from falling below the fixation control temperature. However, for example, in a case where the continuous printing is performed on the paper sheets having a narrower width than an A3 paper sheet, such as letter-size paper sheets, A4 paper sheets, postcard, and A6 paper sheets, heat is taken away only from the center portions of the heating roller 61, the fixing roller 62, the heating belt 63, and the pressure roller 64 by keeping heating the heating roller 61 with the heating width W corresponding to the A3 size. Meanwhile, the heat is not taken away from the end portions in a longitudinal direction (axis direction).

This causes the heat to keep rising at the end portions in the longitudinal direction of the heating roller 61, the fixing roller 62, the heating belt 63, and the pressure roller 64. The heat becoming too high can lead to a problem that a heat failure or the like may occur in the heating belt 63, the fixing roller 62, and the like. Thus, in this embodiment, the core 9 includes the magnetic shielding plates 92A and 92B, and the heating width W of the heating roller 61 can be changed over in a plurality of steps.

Therefore, FIG. 5 is referenced to describe the structure of the core 9. First, the core 9 is a member formed of, for example, ferrite and having a cylindrical shape. By using ferrite being a ferromagnetic material, the magnetic flux of the coil 8 can be converged in a position opposed to the heating roller 61, and linkage of the magnetic flux can be effectively performed on the heating belt 63 and the heating roller 61. Further, ferrite has such a large electrical resistance value that an eddy current loss hardly occurs, which can cause the heating belt 63 and the heating roller 61 to be heated efficiently.

Then, as illustrated in the drawing on the left side of FIG. 5, in the fixing device 6 of this embodiment, the magnetic shielding plates 92A and 92B are provided (pasted) to both ends of the circumferential surface of the core 9. Note that, in FIG. 5, for the sake of convenience, the front surface of the core 9 and the magnetic shielding plates 92A and 92B are distinctively illustrated by hatching the magnetic shielding plates 92A and 92B. Further, functions of the respective magnetic shielding plates 92A and 92B are common, and hence the symbols of A and B are omitted in the following description unless otherwise specified.

For example, the respective magnetic shielding plates 92 are formed of a conductive material such as a copper plate having a small magnetic permeability and a small resistance. When the magnetic flux penetrates the respective magnetic shielding plates 92, according to Lenz's law, a current is caused to flow through a conductive plate in a direction that cancels the magnetic flux to thereby block the magnetic flux. As illustrated in FIG. 5, the respective magnetic shielding plates 92 has a stepwise shape, and allows the heating width W of the heating roller 61 to be changed over by varying the length in the axis direction across which the circumferential surface of the core 9 is covered.

Next described is the drawing of the right side of FIG. 5. The drawing on the right side of FIG. 5 is a development of the circumferential surface of the core 9. For example, the heating width W becomes narrowest when a portion having the largest area that is covered with the magnetic shielding plates 92 and having the shortest portion that is exposed in the axis direction of the heating belt 63 and the heating roller 61 within the circumferential surface of the core 9 is opposed to the heating belt 63. In other words, as the length in the axis direction of a portion of the core 9 covered with the magnetic shielding plates 92, which is opposed to the heating belt 63, becomes longer, the heating width W becomes narrower.

The length of the portion of the core 9 of this embodiment that is covered with the magnetic shielding plates 92 has four steps. For example, the narrowest heating width W (this heating width W is set as heating width W1) corresponds to the length (for example, approximately 10 cm) of the short side of the postcard, the photographic paper sheet, or the A6 paper sheet. In a case of transporting the paper sheet by causing the heating width W1 portion to be opposed to the heating belt 63 and thereby causing a short-side direction of the postcard and the A6 paper sheet and the axis direction of the heating belt 63 to coincide with each other, it is possible to heat only a region (sheet passing region) in which the heating belt 63 and the paper sheet are brought into contact with each other.

The heating width W that is wider than the heating width W1 by one step (this heating width W is set as heating width W2) corresponds to, for example, the length of the short side of the paper sheet of the statement size or the paper sheet of the A5 size (for example, approximately 14 to 15 cm). In a case of transporting the paper sheet (A5 landscape) by causing the heating width W2 portion to be opposed to the heating belt 63 and thereby causing the short-side direction of the A5 paper sheet and the axis direction of the heating belt 63 to coincide with each other, or in a case of transporting the paper sheet by causing the heating width W2 portion to be opposed to the heating belt 63 and thereby causing the long-side direction of the photographic paper sheet, the A6 paper sheet, or the postcard and the axis direction of the heating belt 63 to coincide with each other, it is possible to heat only a region (sheet passing region) in which the heating belt 63 and the paper sheet are brought into contact with each other.

The heating width W that is wider than the heating width W2 by one step (this heating width W is set as heating width W3) corresponds to, for example, the length of the short side of the paper sheet of the letter size or the paper sheet of the A4 size (for example, approximately 21 to 22 cm). In a case of transporting the paper sheet by causing the heating width W3 portion to be opposed to the heating belt 63 and thereby causing the short-side direction of the paper sheet of the letter size or the A4 paper sheet and the axis direction of the heating belt 63 to coincide with each other, or in a case of transporting the paper sheet by causing the heating width W3 portion to be opposed to the heating belt 63 and thereby causing the long-side direction of the paper sheet of the statement size or the A5 paper sheet and the axis direction of the heating belt 63 to coincide with each other, it is possible to heat only a region (sheet passing region) in which the heating belt 63 and the paper sheet are brought into contact with each other.

The widest heating width W (this heating width W is set as heating width W4) corresponds to the length of the short side of the paper sheet of the tabloid size or the paper sheet of the A3 size (for example, approximately 28 to 30 cm). In a case of transporting the paper sheet by causing the heating width W4 portion to be opposed to the heating belt 63 and thereby causing the short-side direction of the paper sheet of the tabloid size or the A3 paper sheet and the axis direction of the heating belt 63 to coincide with each other, or in a case of transporting the paper sheet by causing the heating width W4 portion to be opposed to the heating belt 63 and thereby causing the long-side direction of the paper sheet of the letter size or the A4 paper sheet and the axis direction of the heating belt 63 to coincide with each other, it is possible to heat the region (sheet passing region) in which the heating belt 63 and the paper sheet are brought into contact with each other. The heating width W is changed over by causing the core 9 to rotate by the core motor 93 (corresponding to the rotary section) described later with reference to FIG. 6 according to the output from the paper sheet size sensor 24 or the paper sheet size selected through the operation panel 1.

(Hardware Configuration Regarding Heating Control Performed on Fixing Device 6)

Next, FIG. 6 is referenced to describe an example of a hardware configuration regarding heating control performed on the fixing device 6 according to the first embodiment of the present invention. FIG. 6 is an explanatory diagram illustrating the example of the hardware configuration regarding the heating control performed on the fixing device 6 according to the first embodiment of the present invention.

As illustrated in FIG. 6, the fixing device 6 of this embodiment includes a fixation control section 60 for performing the heating control on the fixing device 6. The fixation control section 60 performs the heating control in response to an instruction issued from the main control section 7. For example, the fixation control section 60 includes a controller 67 serving as a control element. The controller 67 performs actual heating control on the fixing device 6. Further, the fixation control section 60 causes the fixing motor 66 for rotating the heating belt 63, the heating roller 61, the fixing roller 62, and the like to rotate at a predetermined speed during the printing.

Further, the fixation control section 60 includes, for example, a PWM circuit 69 for applying an alternating current to the coil 8 based on power supplied from a power unit 78 provided inside the multifunction peripheral 100. The controller 67 of the fixation control section 60 receives a heating on/off instruction signal for instructing the on/off of the heating from the main control section 7. The controller 67 causes the PWM circuit 69 to supply power to the coil 8 in the case of the heating on instruction.

Further, the main control section 7 gives the controller 67 designation of power to be supplied to and consumed (heat-converted) by the coil 8. Meanwhile, the controller 67 detects power supplied from the PWM circuit 69 to the coil 8 and consumed for heating the heating belt 63 and the heating roller 61. Then, the controller 67 causes the PWM circuit 69 to operate so that the designation given by the main control section 7 coincides with the detected power. For example, the PWM circuit 69 controls an amount of a current caused to flow through the coil 8 by changing a frequency or the like of the current caused to flow through the coil 8, thereby controlling the power consumed by the heating.

With regard to the rotation angle of the core 9, for example, the main control section 7 controls the core motor 93. The core motor 93 causes the core 9 to rotate. With this control, the core 9 is rotated, and the heating width W is changed over. Energy converted into heat becomes small by narrowing the heating width W, and hence the power consumed by the coil 8 becomes small. Further, voltages output from a temperature sensor S1 for sensing the temperature at the center portion of the heating belt 63, a temperature sensor S2 for sensing the temperatures at the end portions of the heating width W2 (end portions in the axis direction of the heating belt 63; the same holds true hereinbelow), a temperature sensor S3 for sensing the temperatures at the end portions of the heating width W3, and a temperature sensor S4 for sensing the temperatures at the end portions of the heating width W4 are input to the CPU 71 of the main control section 7. Then, for example, the storage section 72 stores therein a data table in which temperatures and resistance values of the thermistors are defined in association with voltages output from the respective temperature sensors S. Based on the data table, the main control section 7 can detect the temperatures of the heating belt 63 at the respective portions.

(Heating Control Performed in Print Job)

Figure 7A:
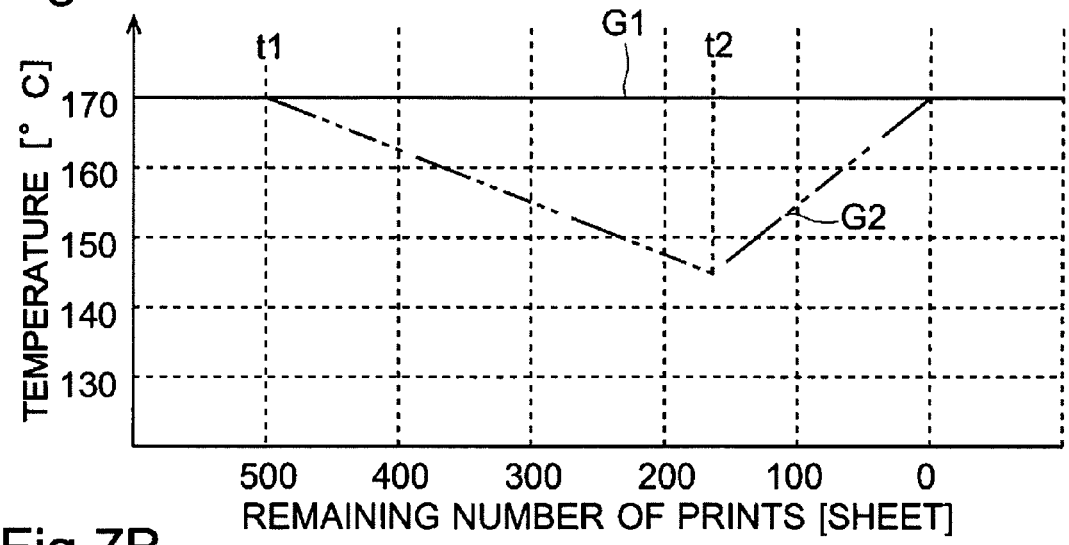
FIGS. 7A to 7C are graphs illustrating examples of changes in temperature of a heating belt during printing performed on the multifunction peripheral according to the first embodiment.
Figure 7B:
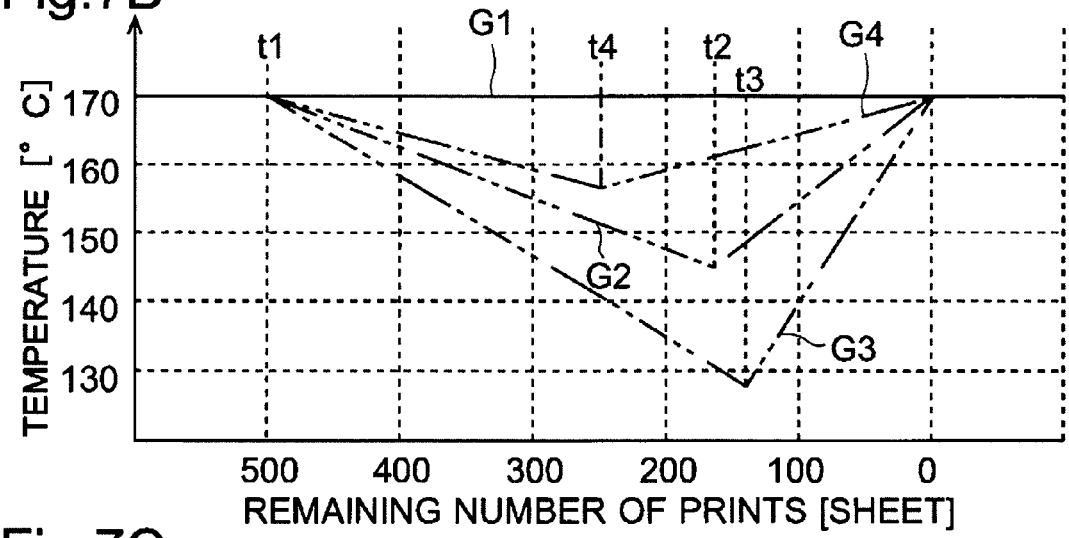
Figure 7C:
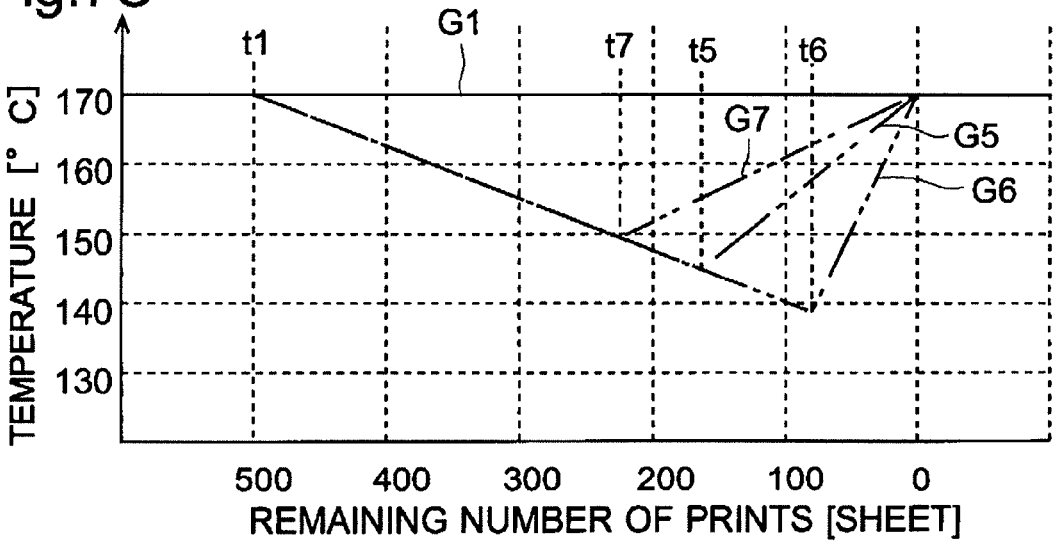

Next, FIGS. 7A to 7C and 8 are referenced to describe an example of the heating control performed in the printing on the multifunction peripheral 100 according to the first embodiment of the present invention. FIGS. 7A to 7C are graphs illustrating examples of changes in temperature of the heating belt 63 during the printing performed on the multifunction peripheral 100 according to the first embodiment of the present invention. FIG. 8 is an explanatory diagram illustrating an example of data for heating used for heating a non-sheet passing region during a print job executed on the multifunction peripheral 100 according to the first embodiment of the present invention.

First, FIG. 7A is referenced to describe an outline of the heating control performed in the print job on the multifunction peripheral 100 of this embodiment. First, FIG. 7A is a graph illustrating the changes in temperature exhibited in the sheet passing region and the non-sheet passing region in a case where, for example, 500 paper sheets are continuously printed by aligning the short-side direction of the paper sheet of the letter size or the A4 paper sheet with the axis direction of the heating belt 63 (by being stacked in the sheet feeding section 2 with the long-side direction of the paper sheet of the letter size or the A4 paper sheet aligned with a sheet feeding direction).

On the multifunction peripheral 100 of this embodiment, at the start of the print job, the core 9 is caused to rotate to a position of the heating width W corresponding to the paper sheet size used for the printing. In this description, the core 9 is caused to rotate so that the heating width W3 portion of the core 9 is opposed to the heating belt 63. The length of the heating width W3 is substantially the same as the length of the short-side direction of the paper sheet of the letter size or the A4 paper sheet. Further, in a state of the heating width W3, the paper sheet is caused to pass in alignment with the portion of the heating belt 63, the fixing roller 62, and the like which is heated by energizing the coil 8. In other words, only the sheet passing region of the heating belt 63, which is brought into contact with the paper sheet, is heated. Then, as illustrated by a graph line G1, indicated by the solid line of FIG. 7A, the sheet passing region is maintained at 170° C., which is the fixation control temperature, from the start of the print job (time point indicated by t1 of FIGS. 7A to 7C) until completion thereof.

Meanwhile, as illustrated by a graph line G2, indicated by the dash-dot-dot line of FIG. 7A, the non-sheet passing region being the portion of the heating belt 63 which is not brought into contact with the paper sheet is not heated at the start of the print job. Therefore, the temperature of the non-sheet passing region is gradually lowered due to heat dissipation and the like. Accordingly, in the first stage of the print job, the power supplied to the coil 8 is not converted into heat for heating the non-sheet passing region, thereby eliminating wasteful power consumption.

However, when the print job is completed without a change from the heating width W3, the temperature of the non-sheet passing region remains low. Therefore, when the printing is performed on, for example, the paper sheet of the tabloid size or the A3 paper sheet immediately after the completion of the print job, the toner is not fused and the fixation is insufficient before the non-sheet passing region has been heated to the fixation control temperature. Accordingly, the user needs to wait until the non-sheet passing region for the preceding print job has been heated.

Thus, on the multifunction peripheral 100 of this embodiment, the control section (the main control section 7) causes the core 9 to rotate to thereby widen the heating width W (for example, change over to the heating width W4) midway through the print job (at a timing of t2 of FIG. 7A). As a result, by the time when the print job is completed, the temperature of the non-sheet passing region can recover the fixation control temperature.

Here, in order to enable the printing to be performed even on the paper sheet having a large size immediately after the completion of the print job, it is desirable that the heating width W be widened at an exact timing for causing the temperature of the non-sheet passing region to reach the fixation control temperature at the completion of the print job (at the completion of the last page of the print job). This is because wasteful power consumption can be eliminated when the non-sheet passing region reaches the fixation control temperature at the completion of the print job.

However, the exact timing to widen the heating width W for causing the temperature of the non-sheet passing region to reach the fixation control temperature at the completion of the print job varies according to the paper sheet size. Thus, FIG. 7B is referenced to describe a difference among the timings to widen the heating width W according to the paper sheet size. FIG. 7B is a graph illustrating the changes in temperature exhibited in the sheet passing region and the non-sheet passing region in the case where, for example, 500 paper sheets are printed.

In FIG. 7B, in the same manner as in FIG. 7A, the graph line G2 represents the change in the temperature of the non-sheet passing region in the case (of the heating width W3) where the printing is performed by aligning the short side of the paper sheet of the letter size or the A4 paper sheet with the axis direction of the heating belt 63. A graph line G3 represents the change in the temperature of the non-sheet passing region in a case (of the heating width W4) where the printing is performed by aligning the short side of the paper sheet of the tabloid size or the A3 paper sheet with the axis direction of the heating belt 63. A graph line G4 represents the change in the temperature of the non-sheet passing region in a case (of the heating width W1) where the printing is performed by aligning the short side of the postcard, the photographic paper sheet, or the A6 paper sheet with the axis direction of the heating belt 63. Note that, all the paper sheets used for the printing are assumed to have the same thickness.

For example, when the description is made by taking the graph line G2 for the A4 paper sheet as a reference, the graph line G3 representing the time of the printing on the paper sheet of the tabloid size or the A3 landscape paper sheet indicates that a temperature dropping rate with respect to the number of prints is larger than that of the graph line G2 (a temperature that drops per print increases). This is because the paper sheet of the tabloid size and the A3 paper sheet are larger than the paper sheet of the letter size and the A4 paper sheet, thereby producing a difference in time required to perform printing on the same number of paper sheets. Meanwhile, the graph line G4 representing the time of the printing on the postcard, the photographic paper sheet, or the A6 paper sheet indicates that the temperature dropping rate with respect to the number of prints is smaller than that of the graph line G2 (a temperature that drops per print decreases). This is because the postcard, the photographic paper sheet, and the A6 paper sheet are smaller than the paper sheet of the letter size and the A4 paper sheet, thereby producing a difference in the time required to perform printing on the same number of paper sheets.

Accordingly, the exact timing to widen the heating width W for causing the temperature of the non-sheet passing region to reach the fixation control temperature at the completion of the print job varies according to the paper sheet size (lags in the timing are indicated by t2, t3, and t4 of FIG. 7B). In other words, in order to cause the non-sheet passing region to reach the fixation control temperature exactly at the completion of the print job, the remaining number of prints of the print job for widening the heating width W varies according to the paper sheet size.

In addition, the exact timing to widen the heating width W for causing the non-sheet passing region to reach the fixation control temperature at the completion of the print job also varies according to the type of the paper sheet (for example, thickness of the paper sheet). Thus, FIG. 7C is referenced to describe a difference in the timing to widen the heating width W according to the type of the paper sheet. FIG. 7C is a graph illustrating an example of the changes in temperature exhibited in the sheet passing region and the non-sheet passing region in the case where, for example, 500 paper sheets of the letter size or 500 A4 paper sheets are printed.

In FIG. 7C, a graph line G5 represents the change in the temperature of the non-sheet passing region in a case where the printing is performed on the paper sheet having such a thickness as to be called copy paper or plain paper (for example, basis weight of approximately 60 to 100 g/m2). A graph line G6 represents the change in the temperature of the non-sheet passing region in a case where the printing is performed on the paper sheet having such a thickness as to be called cardboard (for example, basis weight of equal to or larger than 100 g/m2, or approximately 100 to 160 g/m2). A graph line G7 represents the change in the temperature of the non-sheet passing region in a case where the printing is performed on the paper sheet having such a thickness as to be called thin paper (for example, basis weight of equal to or smaller than 60 g/m2).

Note that, which paper sheet is classified into which thickness can be arbitrarily defined according to, for example, the model of the image forming apparatus. A standard paper sheet specified by the image forming apparatus may be defined for each of the cardboard, the plain paper, and the thin paper to allow the user to use the standard paper sheet, or a basis weight corresponding to the type of the paper sheet may be described in an instruction manual.

For example, when the description is made by taking the graph line G5 representing the change in the temperature of the non-sheet passing region of the plain paper as a reference, the graph line G6 representing the change in the temperature of the non-sheet passing region of the cardboard indicates that a temperature rising rate for the non-sheet passing region is larger than that of the graph line G5. This is because the heat taken away by the paper sheet is more than that taken away by the plain paper in the case where the fixation is performed on the cardboard. Therefore, it is necessary to maintain the temperature of the sheet passing region at the fixation control temperature by supplying more power (causing a larger current to flow) to the coil 8 than in the case of the plain paper and increasing a heating value due to the induction heating. In the printing on the cardboard, the temperature rising rate for the non-sheet passing region becomes larger than in the case where the printing is performed on the plain paper or the thin paper. Meanwhile, the graph line G7 representing the change in the temperature of the non-sheet passing region of the thin paper indicates that the temperature rising rate for the non-sheet passing region is smaller than that of the graph line G5. This is because the heat taken away by the paper sheet can be suppressed to a lower level than in the case of the plain paper in maintaining the temperature of the sheet passing region at the fixation control temperature in the case where the fixation is performed on the thin paper. Therefore, only a smaller power is supplied to the coil 8 than in the case of the plain paper, and in the printing on the thin paper, the temperature rising rate for the non-sheet passing region becomes smaller than in the case where the printing is performed on the plain paper or the cardboard.

Accordingly, the exact timing to widen the heating width W for causing the temperature of the non-sheet passing region to reach the fixation control temperature at the completion of the print job also varies according to the type (thickness) of the paper sheet. In other words, in order to cause the temperature of the non-sheet passing region to reach the fixation control temperature exactly at the completion of the print job, the remaining number of prints of the print job for widening the heating width W varies according to the type of the paper sheet. Thus, on the multifunction peripheral 100 of this embodiment, as illustrated in FIG. 8, the data for heating (data table) in which the timing to widen the heating width W is defined in association with the temperature of the non-sheet passing region is defined for each of the paper sheet size and the type of the paper sheet. The data for heating is stored in, for example, the storage section 72.

The main control section 7 senses the temperature of the non-sheet passing region based on the output from the temperature sensor S located in the non-sheet passing region. When a plurality of temperature sensors S are located in the non-sheet passing region, the main control section 7 may determine the temperature of the non-sheet passing region by averaging results of detecting the plurality of temperatures of the non-sheet passing region. Further, the main control section 7 may determine the lowest temperature as the temperature of the non-sheet passing region.

Then, the main control section 7 determines the timing to widen the heating width W (remaining number of prints) based on the size and type of the paper sheet being currently printed. For example, the main control section 7 may recognize the size and type of the paper sheet used for the print job based on the output from the paper sheet size sensor 24, a setting on the type of the paper sheet received in the sheet feeding section 2 specified by using the operation panel 1, and print setting data transmitted from the computer 200 to the multifunction peripheral 100.

This allows the printing to be performed on the paper sheet larger (corresponding to wider heating width W) than that used for the preceding print job immediately after the completion of the print job. Note that, the data for heating may be defined to have a certain amount of margin so that the temperature of the non-sheet passing region reaches the fixation control temperature before the completion of the print job. Further, even when the temperature of the non-sheet passing region reaches the fixation control temperature before the completion of the print job, for example, the core 9 may be caused to rotate to thereby narrow the heating width W according to the paper sheet size being subjected to the printing. This prevents the occurrence of an excessive temperature rise in the non-sheet passing region.

(Heating Control Performed on Fixing Device 6 at Execution of Print Job)

Figure 9:
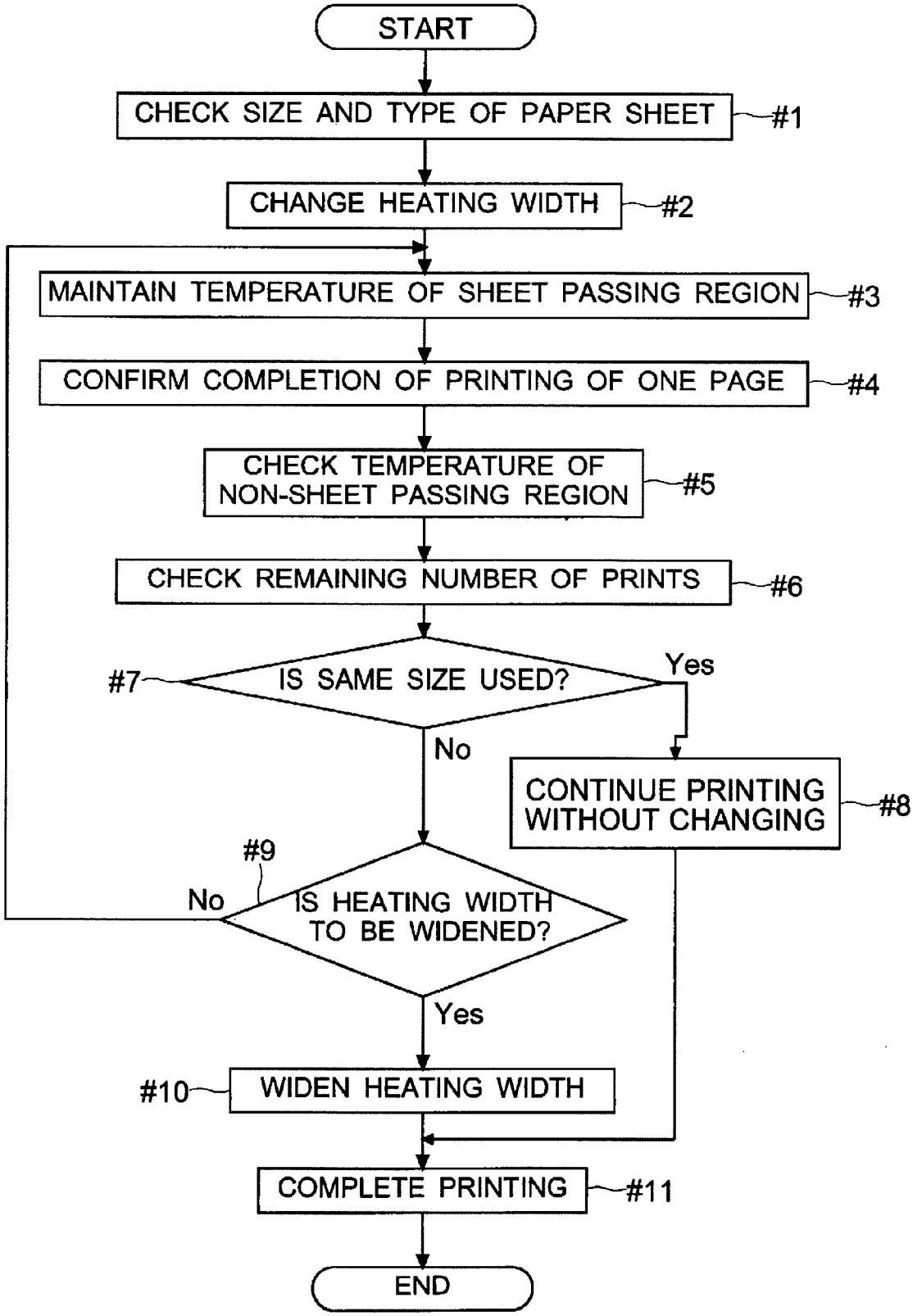
FIG. 9 is a flowchart illustrating an example of a flow of the heating control performed on the fixing device at execution of the print job according to the first embodiment of the present invention.

Next, FIG. 9 is referenced to describe an example of a flow of the heating control performed on the fixing device 6 according to the first embodiment of the present invention. FIG. 9 is a flowchart illustrating the example of the flow of the heating control performed on the fixing device 6 at execution of the print job according to the first embodiment of the present invention.

First, the start of FIG. 9 is set to a time point at which the execution of the print job is started. Examples thereof include a time point at which the start key 10 is depressed for executing copying and a time point at which data on the print job including the image data and the print setting data is received from the computer 200. Note that, the print job here is a print job for a smaller size than the maximum size (for example, tabloid size or A3) of the paper sheet that can be used on the multifunction peripheral 100. In other words, in the case of the printing on the paper sheet (tabloid size or A3) corresponding to the maximum heating width (the heating width W4), the main control section 7 maintains the maximum heating width (heating width W4), which eliminates the need for control to rotate the core 9.

Subsequently, the main control section 7 checks the size and the type of the paper sheet used for the printing (Step #1). Specifically, the multifunction peripheral 100 includes, for example, the communication section (I/F section 73) for receiving print data including print setting data from an external section. In a case where the multifunction peripheral 100 functions as a printer, the main control section 7 recognizes at least one of the size and the type of the paper sheet used for the printing based on the print setting data received by the communication section. Alternatively, the multifunction peripheral 100 includes, for example, the operation input section (operation panel 1) for inputting a setting on the size of the paper sheet used for the printing, and the main control section 7 recognizes at least one of the size and the type of the paper sheet used for the printing based on the contents input through the operation input section.

The main control section 7 then instructs the core motor 93 to rotate the core 9 as necessary, and sets the heating width W corresponding to the paper sheet size (changes over to any one of the heating widths W1 to W3) (Step #2). Note that, on the multifunction peripheral 100 of this embodiment, in order to enable the subsequent printing to be performed on the paper sheet having any size immediately after the completion of the print job, the main control section 7 sets, for example, the maximum width (heating width W4) as a basic position of the heating width W at the completion of one print job. Then, the main control section 7 instructs the fixation control section 60 to maintain the temperature of the sheet passing region at the fixation control temperature based on the output from the temperature sensor S for measuring the temperature of the sheet passing region (Step #3).

Then, the main control section 7 confirms completion of printing on one paper sheet (Step #4). The main control section 7 may recognize the completion of the printing of one page (on one paper sheet) by detecting that one paper sheet has been delivered onto the delivery tray 31 based on an output from the paper sheet sensor 35 provided in the vicinity of the delivery roller pair 34. Further, a time taken from the sheet feeding until the delivery of the paper sheet is substantially determined according to the paper sheet size and the like, and hence the main control section 7 may confirm the completion of the printing on one paper sheet based on a time that has elapsed after one paper sheet was fed.

In addition, the main control section 7 checks the temperature of the non-sheet passing region based on the output from the temperature sensor S (for example, temperature sensor S4) for measuring the temperature of the non-sheet passing region portion (Step #5). In addition, the main control section 7 checks the remaining number of prints of the print job (Step #6).

Note that, the main control section 7 may judge that it is unnecessary to widen the heating width W when the same paper sheet size is used for the current print job and the subsequent print job, and the heating width W may be widened at the time of execution of the subsequent print job. Thus, the main control section 7 may check the setting contents of the subsequent print job (printer job input to the multifunction peripheral 100 or copy job the execution of which has been instructed) during the execution of the current print job to thereby check whether or not the same paper sheet size is used for the current print job and the subsequent print job (Step #7).

When the same paper sheet size is used for the current print job and the subsequent print job (Yes in Step #7), the main control section 7 continues printing without changing the heating width W until the completion of the print job (Step #8→Step #11). On the other hand, when the same paper sheet size is not used (No in Step #7), the main control section 7 advances to Step #9. Note that, in a case where no subsequent print job has been input to the multifunction peripheral 100, the main control section 7 judges No in Step #7.

That is, the control section (main control section 7) checks during the execution of the current print job whether or not the same paper sheet size is used for the current print job and the subsequent print job, and when the same paper sheet size is used for the current print job and the subsequent print job, continues printing without changing the heating width W until the completion of the print job. Accordingly, it is possible to reduce the wasteful power consumption due to needless heating of the non-sheet passing region.

Then, the main control section 7 judges whether or not the timing to widen the heating width W has been reached based on the temperature of the non-sheet passing region, the remaining number of prints of the print job, and the data for heating (Step #9).

That is, the multifunction peripheral 100 includes the storage section 72 for storing data. When the heating section is heated with the heating width W widened midway through the print job, the storage section 72 stores the data for heating in which the remaining number of prints of the print job necessary to increase the temperature of the non-sheet passing region to the fixation control temperature at the completion of the print job is defined, in association with the temperature of the non-sheet passing region sensed based on the output from the temperature sensing element (temperature sensor S). Based on the data for heating, the main control section 7 determines the timing to cause the heating section to be heated with the heating width W widened midway through the print job. Further, the storage section 72 stores a plurality of kinds of the data for heating according to the size of the paper sheet that can be used on the image forming apparatus. The main control section 7 selects the data for heating corresponding to the size of the paper sheet used for the printing from among the plurality of kinds of the data for heating, and uses the selected data for heating to determine the timing to cause the heating section to be heated with the heating width W widened midway through the print job. In addition, the storage section 72 stores a plurality of kinds of the data for heating according to the type of the paper sheet that can be used on the image forming apparatus. The main control section 7 selects the data for heating corresponding to the type of the paper sheet used for the printing from among the plurality of kinds of the data for heating, and uses the selected data for heating to determine the timing to cause the heating section to be heated with the heating width W widened midway through the print job.

When the main control section 7 judges that the timing to widen the heating width W has not been reached (No in Step #9), the main control section 7 returns to, for example, Step #3. On the other hand, when the main control section 7 judges that the timing to widen the heating width W has been reached (Yes in Step #9), the main control section 7 controls the core motor 93 to widen the heating width W (Step #10). At this time, in a case where the paper sheet size used for the subsequent print job is unknown, the heating width W is widened to the maximum heating width W (heating width W4) corresponding to the A3 size. When the paper sheet size used for the subsequent print job is known, for example, in a case where the printer job is input during the execution of the current print job, the main control section 7 may widen the heating width W to the heating width W corresponding to the paper sheet size used for the subsequent print job.

That is, the main control section 7 controls the rotary section (core motor 93) to set the heating width W corresponding to the paper sheet size at the start of the print job, and midway through the print job, controls the rotary section to cause the heating section to be heated with the heating width W set wider than at the start of the print job. Specifically, the main control section 7 sets the heating width W to the heating width W corresponding to the paper sheet size at the start of the print job so that the non-sheet passing region of the heating section which is not brought into contact with the paper sheet to which the fixation is performed becomes widest, and in a case of causing the heating section to be heated with the heating width W widened midway through the print job, causes the heating section to be heated so that the temperature of the non-sheet passing region reaches the fixation control temperature, which is a temperature level necessary for the fixation, by the time of the completion of the print job. Then, when the paper sheet size used for the subsequent print job is unknown, in the case where the heating section is heated with the heating width W set wider than at the start of the print job midway through the print job, the main control section 7 causes the heating section to be heated with the heating width W widened to the heating width W corresponding to the paper sheet having the largest size among the paper sheets received in the sheet feeding sections 2. Further, when the paper sheet size used for the subsequent print job is known, in the case where the heating section is heated with the heating width W set wider than at the start of the print job midway through the print job, the main control section 7 causes the heating section to be heated with the heating width W widened to the heating width W corresponding to the size of the paper sheet used for the subsequent print job.

After that, the printing is continued, and the print job is completed (Step #11). At this time, the non-sheet passing region is heated to reach the fixation control temperature, and the heating control at the time of the execution of the print job is finished (end). For example, when the print job is not started immediately after the completion of the print job, the main control section 7 performs control to maintain the fixation control temperature with the maximum heating width W4 by switching the on/off states of the power supplied to the coil 8 until transition to a power saving mode such as a sleep mode.

As described above, according to the multifunction peripheral 100 of this embodiment, the heating width W corresponding to the paper sheet size is set at the start of the print job, and midway through the print job, the heating width W is set wider than at the start of the print job. Therefore, at the start of the print job, the heating is not performed in the non-sheet passing region within the heating section (heating belt 63 and the like). Accordingly, it is possible to eliminate the wasteful power consumption due to needless heating of the non-sheet passing region. Further, even when the size of the paper sheet used for the subsequent print job after the completion of the print job is larger than the size of the paper sheet used for the preceding print job, the user does not need to wait in order to heat the entire sheet passing region of the paper sheet used for the subsequent print job to the fixation control temperature. Accordingly, the print job for a different paper sheet size can be executed immediately after the completion of the preceding print job, which enhances convenience for the user.

Further, the heating section (heating belt 63 and the like) is heated so that the temperature of the non-sheet passing region reaches the fixation control temperature by the time of the completion of the print job. Accordingly, even when the size of the paper sheet used for the subsequent print job after the completion of the print job is larger than the size of the paper sheet used for the preceding print job, the printing can reliably be executed immediately after the completion of the preceding print job. Further, the timing to cause the heating section (heating belt 63 and the like) to be heated with the heating width W widened is determined based on the data for heating midway through the print job, and hence the control section (main control section 7) can easily determine the timing to cause the heating section to be heated with the heating width W widened. Further, the data for heating is defined so that the temperature of the non-sheet passing region reaches the fixation control temperature at the completion of the print job, which can reduce the wasteful power consumption due to needless heating of the non-sheet passing region to a minimum.

Further, as the paper sheet becomes longer in the paper sheet transport direction, more heat is taken away by the paper sheet in the sheet passing region when the printing is performed on one paper sheet. Accordingly, the time required to perform the printing on one sheet varies according to the size of the paper sheet in order to maintain the fixation control temperature of the sheet passing region. Therefore, there occurs a difference in the power (energy to be converted into heat) to be supplied to the coil 8. In other words, the remaining number of prints of the print job, which is a guide for the timing to widen the heating width midway through the print job, differs according to the paper sheet size. However, the storage section 72 stores the plurality of kinds of the data for heating according to the paper sheet size that can be used on the image forming apparatus. Accordingly, irrespective of the size of the paper sheet used for the printing, it is possible to reduce the wasteful power consumption due to needless heating of the non-sheet passing region to a minimum.

Further, as the paper sheet becomes thicker, more heat is taken away by the paper sheet in the sheet passing region when the printing is performed on one paper sheet. This produces a difference in the power to be supplied to the coil 8 according to the type of the paper sheet in order to maintain the fixation control temperature of the sheet passing region. Therefore, according to the type of the paper sheet, there occurs a difference in the extent to which the temperature of the non-sheet passing region rises when the heating width W is widened midway through the print job. However, the storage section 72 stores the plurality of kinds of the data for heating according to the type of the paper sheet that can be used on the image forming apparatus. Accordingly, irrespective of the type of the paper sheet used for the printing, it is possible to reduce the wasteful power consumption due to needless heating of the non-sheet passing region to a minimum.

Further, it is generally impossible to predict which size of paper sheet is to be used for the subsequent print job after the print job is finished. Thus, the control section causes the heating section (heating belt 63 and the like) to be heated with the heating width W widened to the heating width W (in this embodiment, heating width W4) corresponding to the paper sheet having the largest size (in a direction perpendicular to the paper sheet transport direction) among the paper sheets received in the sheet feeding sections 2. This enables the print job to be started immediately even when the paper sheet having any size is used for the subsequent print job. Further, it is possible to provide the image forming apparatus which is high in convenience while realizing energy conservation.

Further, the size of the paper sheet used for the subsequent print job may be known during the execution of the print job in a case where, for example, the subsequent print job is input to the image forming apparatus. Thus, the control section causes the heating section (heating belt 63 and the like) to be heated with the heating width W widened to the heating width W corresponding to the size of the paper sheet used for the subsequent print job. This avoids the heating of a needless region during the execution of the subsequent print job, thereby preventing the wasteful power consumption. Further, the subsequent print job can be started immediately after the completion of the print job, thereby enabling to provide the image forming apparatus which is high in convenience while realizing energy conservation.

Further, the control section (main control section 7) can recognize the size and the type of the paper sheet used for the printing based on the print setting data received by the communication section (I/F section 73). Further, the control section can recognize the size and the type of the paper sheet used for the printing based on the contents input through the operation input section (operation panel 1).

Second Embodiment

Figure 10:
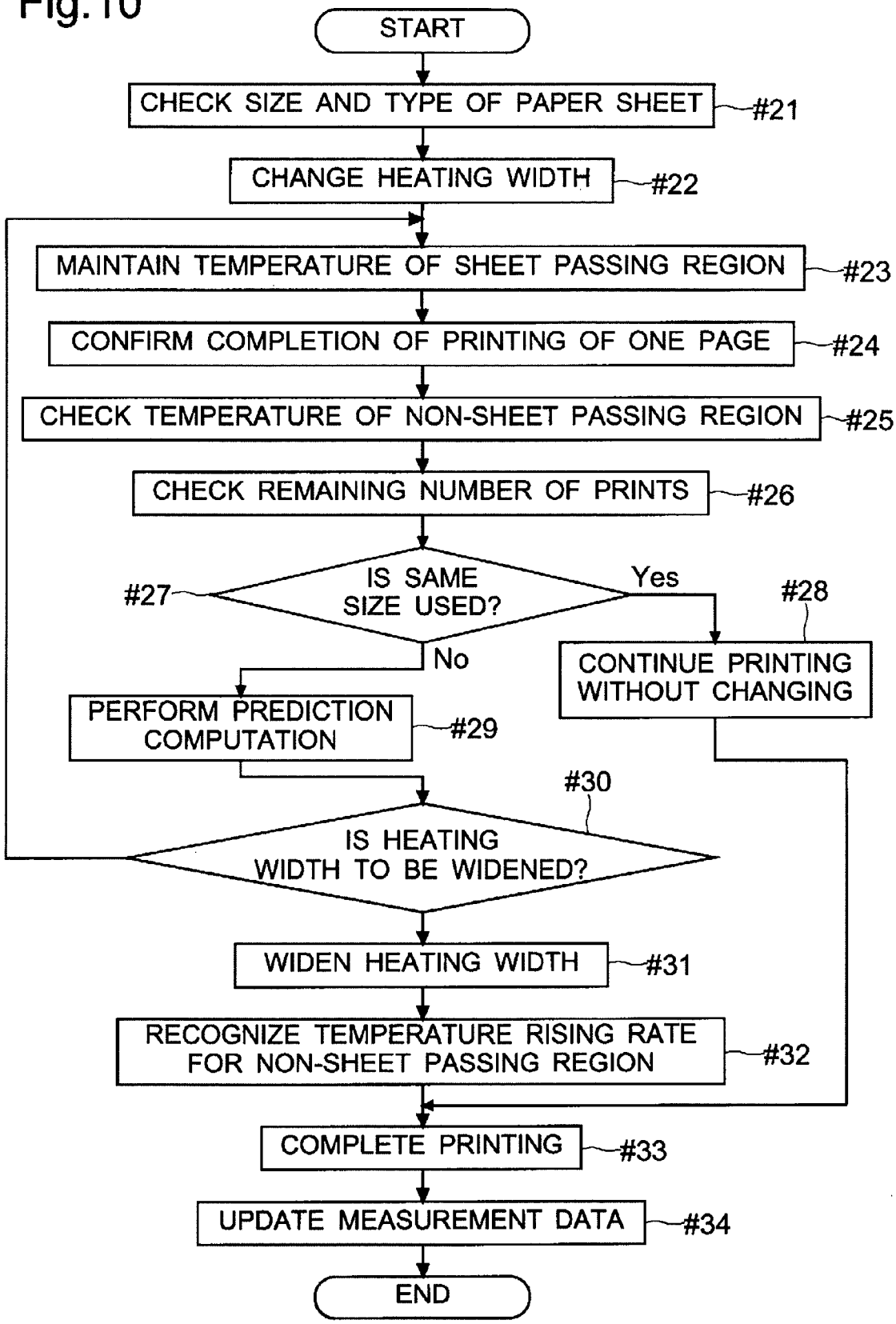
FIG. 10 is a flowchart illustrating an example of a flow of heating control performed on a fixing device at execution of a print job according to a second embodiment of the present invention.

Next, FIGS. 10 and 11 are referenced to describe a multifunction peripheral 100 according to a second embodiment of the present invention. FIG. 10 is a flowchart illustrating an example of a flow of heating control performed on the fixing device 6 at execution of the print job according to the second embodiment of the present invention. FIG. 11 is an explanatory diagram illustrating an example of measurement data on a temperature rising rate obtained from the multifunction peripheral 100 according to the second embodiment of the present invention.

Note that, the second embodiment is different from the first embodiment in that the timing to widen the heating width W is determined at the execution of the print job based on the temperature rising rate for the non-sheet passing region which is measured on the multifunction peripheral 100. However, the other components may be the same as those of the first embodiment, and description of the common components is omitted by using the common reference symbols therefor.

First, in the second embodiment, as illustrated in FIG. 11, measurement results of the temperature rising rate obtained in the case where the non-sheet passing region is heated midway through the print job are accumulated as data. Then, as described with reference to FIGS. 7A to 7C, the temperature rising rate for the non-sheet passing region with the heating width W widened varies according to the size and the type (thickness) of the paper sheet because of the difference in the power to be supplied to the coil 8 in order to maintain the fixation control temperature of the sheet passing region or other such factor. Thus, the measurement results of the temperature rising rate obtained in the case of heating the non-sheet passing region are stored in the storage section 72 according to the pattern of widening the heating width W and the type of the paper sheet in association with the paper sheet to be used (exemplified as A1 to A15 in the example of FIG. 11). For example, the measurement results of the temperature rising rate are stored for each of patterns such as "postcard or the like (heating width W1)→tabloid size or A3 paper sheet (heating width W4)".

Note that, there are various methods of determining the temperature rising rate. For example, by storing the temperature rising rate for the non-sheet passing region for each of the patterns (including the type of the paper sheet, the size of the paper sheet used for the printing, and the original heating width W and the widened heating width W) over a fixed period such as the past week or the past month, the average value of the respective measurement results may be determined as the temperature rising rate within the measurement data (therefore, the storage section 72 stores, for example, the measurement results of the rise in the temperature of the non-sheet passing region for each print job and for each pattern over a fixed period). Alternatively, the temperature rising rate measured in the print job executed most recently which has the same pattern may be used as the measurement data.

Further, in the second embodiment, as illustrated at the bottom of FIG. 11, for example, time data representing a printing duration per paper sheet (page) of the paper sheet used for the print job is stored together in order to calculate the time to complete the print job (printing durations per paper sheet are exemplified as T1 to T4 in FIG. 11).

The main control section 7 references the above-mentioned data to determine the timing to widen the heating width W based on the temperature rising rate for the non-sheet passing region measured on the multifunction peripheral 100. Thus, FIG. 10 is referenced to describe the example of the heating control performed on the fixing device 6 at the execution of the print job. Note that, Steps #21 to #28 illustrated in FIG. 10 may be the same as Steps #1 to #8 of the first embodiment, and hence description thereof is omitted.

In Step #30, it is checked whether or not to widen the heating width W. At this time, the main control section 7 uses the time data stored in the storage section 72 to compute a duration required to complete the printing on the remaining number of sheets for the print job. The computed duration required to complete the printing is referred to as "printing duration". Specifically, as in the following (Expression 1), the printing duration can be obtained by multiplying the remaining number of sheets for the print job by the time data on the paper sheet used for the current printing.

(printing duration(second))=(remaining number of sheets for print job (sheet))×(time data(second)) (Expression 1)

Further, in the case of widening the heating width W, the main control section 7 performs computation to obtain the time required to raise the temperature of the non-sheet passing region to the fixation control temperature. The computed time required to raise the temperature of the non-sheet passing region to the fixation control temperature is referred to as "rising duration". Specifically, as in the following (Expression 2), the rising duration can be obtained by dividing a difference between the fixation control temperature and the temperature of the non-sheet passing region by the temperature rising rate for the corresponding pattern in the change of the heating width W within the measurement data.

(rising duration(second))=((fixation control temperature)−(temperature of non-sheet passing region)(° C.))÷temperature rising rate(° C./second)) (Expression 2)

Then, the main control section 7 compares the printing duration with the rising duration, and determines the timing to widen the heating width W during a period in which the rising duration is equal to or shorter than the printing duration ((rising duration)≦(printing duration)). By thus determining the timing, the temperature of the non-sheet passing region reaches the fixation control temperature at or before the completion of the print job.

That is, the multifunction peripheral 100 includes the storage section 72 for storing data. The storage section 72 stores the measurement data on the temperature rising rate for the non-sheet passing region obtained when the heating section is heated with the heating width W widened midway through the print job. The main control section 7 references the measurement data to obtain the rising duration required to raise the temperature of the non-sheet passing region sensed by the temperature sensing element (temperature sensor S) to the fixation control temperature and the printing duration required to complete the printing of the remaining number of prints of the print job, performs comparison therebetween, and determines the timing to cause the heating section to be heated with the heating width W widened midway through the print job during a period in which the rising duration is shorter than the printing duration required to complete the printing of a remaining number of prints of the print job. For example, the main control section 7 may determine that the heating width W is to be widened when the difference between the printing duration and the rising duration becomes lower than a predetermined value (arbitrary value between, for example, 1 to 10 seconds).

Further, the storage section 72 stores a plurality of kinds of the measurement data according to the size of the paper sheet that can be used on the image forming apparatus. The main control section 7 selects the measurement data corresponding to the size of the paper sheet used for the printing from among the plurality of kinds of the measurement data, and uses the selected measurement data to determine the timing to cause the heating section to be heated with the heating width W widened midway through the print job. Further, the storage section 72 stores the plurality of kinds of the measurement data according to the type of the paper sheet that can be used on the image forming apparatus. The main control section 7 selects the measurement data corresponding to the type of the paper sheet used for the printing from among the plurality of kinds of the measurement data, and uses the selected measurement data to determine the timing to cause the heating section to be heated with the heating width W widened midway through the print job.

In addition, in order to maintain the temperature of the non-sheet passing region at the fixation control temperature exactly when the print job is completed, the timing to widen the heating width W is determined by, for example, the following prediction computation. For example, the main control section 7 can recognize the temperature of the non-sheet passing region which is dropping during the printing per sheet (per page). That is, the temperature sensor S for sensing the temperature of the non-sheet passing region may measure the temperature each time the printing of one page is completed, and the main control section 7 may recognize a temperature difference between the temperature measured at the completion of the printing of a given page and the temperature measured at the completion of the printing of the preceding page each time the printing of one page is completed. For example, in a case where the print job involves as many as 500 sheets or other such case of a large number of prints, the temperature difference may be obtained each time one page is printed, and the average value of a plurality of temperature differences that have been obtained may be found.

This enables the main control section 7 to perform the prediction computation for the temperature of the non-sheet passing region to be obtained at the completion of the printing of the subsequent page. Accordingly, the main control section 7 computes the rising duration for raising the temperature of the non-sheet passing region predicted to be obtained at the completion of the printing of the subsequent page to the fixation control temperature. Further, by multiplying the remaining number of prints at the completion of the printing of the subsequent page by the time data, it is possible to easily compute the printing duration at the completion of the printing of the subsequent page. Then, in a case where the rising duration at the completion of the printing of the subsequent page is shorter than the printing duration at the completion of the printing of the subsequent page, the temperature of the non-sheet passing region can be raised to the fixation control temperature at the completion of the print job even when the heating width W is widened at the completion of the printing of the subsequent page, and hence the main control section 7 does not judge at this point in time that the heating width W is to be widened (No in Step #30). On the other hand, in a case where the rising duration at the completion of the printing of the subsequent page is longer than the printing duration at the completion of the printing of the subsequent page, the temperature of the non-sheet passing region cannot be raised to the fixation control temperature at the completion of the print job even when the heating width W is widened at the completion of the printing of the subsequent page, and hence the main control section 7 judges at this point in time that the heating width W is to be widened (Yes in Step #30).

That is, the main control section 7 may measure the temperature by using the temperature sensor S for sensing the temperature of the non-sheet passing region each time the printing of one page is completed, perform the prediction computation for the temperature of the non-sheet passing region at the completion of the printing of the subsequent page, compute the rising duration for raising the temperature of the non-sheet passing region at the completion of the printing of the subsequent page which has been obtained by the prediction computation to the fixation control temperature, further compute the printing duration at the completion of the printing of the subsequent page by multiplying the remaining number of prints at the completion of the printing of the subsequent page by the time data, and when the rising duration at the completion of the printing of the subsequent page becomes longer than the printing duration at the completion of the printing of the subsequent page, judge that the heating width W is to be widened. In this case, the temperature of the non-sheet passing region can be raised to the fixation control temperature exactly when the print job is completed. Thus, in the case of determining the timing to widen the heating width W by predicting the temperature of the non-sheet passing region at the completion of the printing of the subsequent page, the main control section 7 performs the prediction computation for the temperature of the non-sheet passing region at the completion of the printing of the subsequent page in the preceding step of Step #30 (Step #29).

When the main control section 7 judges that the heating width W is not to be widened (No in Step #30), the main control section 7 returns to, for example, Step #23. On the other hand, when the main control section 7 judges that the heating width W is to be widened (Yes in Step #30), the main control section 7 controls the core motor 93 to widen the heating width W (Step #31). Note that, Step #31 may be the same as Step #10 of the first embodiment, and hence detailed description thereof is omitted.

After that, the main control section 7 recognizes the temperature rising rate for the non-sheet passing region in the current print job (Step #32). After that, the printing is completed (Step #33). Then, based on the recognized temperature rising rate, the main control section 7 updates the corresponding items of measurement data (type of the paper sheet, paper sheet used for the printing, and heating widths W before and after being widened) within the measurement data stored in the storage section 72 (Step #34→end).

As described above, according to the multifunction peripheral 100 of this embodiment, the control section references the measurement data to determine the timing to cause the heating section (heating belt 63, heating roller 61, fixing roller 62, and the like) to be heated with the heating width W widened midway through the print job during the period in which the rising duration is shorter. Hence, the control section can determine the timing to cause the heating section to be heated with the heating width W widened in consideration of an environment in which the image forming apparatus is installed (such as a peripheral temperature), an individual difference in the extent to which the heating section (heating belt 63 and the like) is heated, and other such circumstances. Accordingly, the heating control can be performed according to the circumstances, which can eliminate the wasteful power consumption with efficiency.

Further, as the paper sheet becomes longer in the paper sheet transport direction, more heat is taken away by the paper sheet in the sheet passing region when the printing is performed on one paper sheet. Accordingly, the power to be supplied to the coil 8 varies according to the size of the paper sheet in order to maintain the fixation control temperature of the sheet passing region. Therefore, according to the paper sheet size, there occurs a difference in the extent to which the temperature of the non-sheet passing region rises when the heating width W is widened midway through the print job. However, the storage section 72 stores the plurality of kinds of the measurement data according to the size of the paper sheet that can be used on the image forming apparatus. Accordingly, irrespective of the size of the paper sheet used for the printing, it is possible to reduce the wasteful power consumption due to needless heating of the non-sheet passing region according to the environment in which the image forming apparatus is installed. Further, as the paper sheet becomes thicker, more heat is taken away by the paper sheet in the sheet passing region when the printing is performed on one paper sheet. This produces a difference in the power to be supplied to the coil 8 according to the type of the paper sheet in order to maintain the fixation control temperature of the sheet passing region. Therefore, according to the type of the paper sheet, there occurs a difference in the extent to which the temperature of the non-sheet passing region rises when the heating width W is widened midway through the print job. However, the storage section 72 stores the plurality of kinds of the measurement data according to the type of the paper sheet that can be used on the image forming apparatus. Accordingly, irrespective of the type of the paper sheet used for the printing, it is possible to reduce the wasteful power consumption due to needless heating of the non-sheet passing region according to the environment in which the image forming apparatus is installed.

The embodiments of the present invention have been described above, but the scope of the present invention is not limited thereto, and various modifications can be made to the implementation thereof without departing from the gist of the invention.

What is claimed is:

1. An image forming apparatus, comprising:

a sheet feeding section for receiving a paper sheet used for printing;

an image forming section for forming a toner image;

a heating section comprising a rotary member that is brought into contact with the paper sheet, for fixation of the toner image;

a coil that is opposed to the heating section and is wound around the rotary member in an axis direction thereof, for heating the heating section by induction heating;

a core that is opposed to the heating section, forms a magnetic path between the coil and the heating section, and has a circumferential surface covered with a magnetic shielding plate, the circumferential surface covered with the magnetic shielding plate having different lengths in the axis direction in a plurality of steps according to a position in a circumferential direction;

a rotary section for causing the core to rotate;

a plurality of temperature sensing elements for sensing temperatures of the heating section according to a heating width; and a control section for controlling power to be supplied to the coil based on an output from each of the plurality of temperature sensing elements, recognizing a size of the paper sheet used for the printing, controlling the heating width in the heating section by controlling the rotary section to control a rotation angle of the core, controlling the rotary section to set the heating width corresponding to the size of the paper sheet at a start of a print job, and causing the heating section to be heated by controlling the rotary section to set the heating width wider than at the start of the print job such that, irrespective of whether the paper sheet size used for a subsequent print job is known or unknown, a non-sheet passing region is heated to a fixation control temperature before the print job is completed.

2. An image forming apparatus according to claim 1, wherein the control section sets the heating width corresponding to the size of the paper sheet at the start of the print job so as to leave a widest non-sheet passing region, which is a region of the heating section not in contact with the paper sheet during the fixation, and in a case where the heating section is heated with the heating width widened midway through the print job, causes the heating section to be heated so that a temperature of the non-sheet passing region reaches a fixation control temperature, which is a temperature level necessary for the fixation a sheet, by a time of completion of the print job.

3. An image forming apparatus according to claim 1, further comprising a storage section for storing data, wherein: the storage section stores data for heating in which a remaining number of prints of the print job for causing a temperature of a non-sheet passing region to reach a fixation control temperature being a temperature level necessary for the fixation at completion of the print job is defined in association with the temperature of the non-sheet passing region sensed based on the output from the each of the plurality of temperature sensing elements in a case where the heating section is heated with the heating width widened midway through the print job; and the control section references the data for heating to determine a timing to cause the heating section to be heated with the heating width widened midway through the print job.

4. An image forming apparatus according to claim 3, wherein: the storage section stores a plurality of kinds of the data for heating according to the size of the paper sheet that can be used on the image forming apparatus; and the control section selects the data for heating corresponding to the size of the paper sheet used for the printing from among the plurality of kinds of the data for heating, and uses the selected data for heating to determine the timing to cause the heating section to be heated with the heating width widened midway through the print job.

5. An image forming apparatus according to claim 3, wherein: the storage section stores a plurality of kinds of the data for heating according to a type of the paper sheet that can be used on the image forming apparatus; and the control section selects the data for heating corresponding to the type of the paper sheet used for the printing from among the plurality of kinds of the data for heating, and uses the selected data for heating to determine the timing to cause the heating section to be heated with the heating width widened midway through the print job.

6. An image forming apparatus according to claim 4, wherein: the storage section stores a plurality of kinds of the data for heating according to a type of the paper sheet that can be used on the image forming apparatus; and the control section selects the data for heating corresponding to the type of the paper sheet used for the printing from among the plurality of kinds of the data for heating, and uses the selected data for heating to determine the timing to cause the heating section to be heated with the heating width widened midway through the print job.

7. An image forming apparatus according to claim 1, wherein the control section causes the heating section to be heated with the heating width widened to the heating width corresponding to the paper sheet having a largest size among the paper sheets received in the sheet feeding section in a case where the heating section is heated midway through the print job with the heating width set wider than at the start of the print job.

8. An image forming apparatus according to claim 1, wherein the control section causes the heating section to be heated with the heating width widened to the heating width corresponding to the size of the paper sheet used for a subsequent print job in a case where the heating section is heated midway through the print job with the heating width set wider than at the start of the print job.

9. An image forming apparatus according to claim 1, further comprising a communication section for receiving print data containing print setting data from an external section, wherein the control section recognizes at least one of the size and a type of the paper sheet used for the printing based on the print setting data received by the communication section.

10. An image forming apparatus according to claim 9, wherein the control section checks during execution of a current print job whether or not the same size of the paper sheet is used for the current print job and a subsequent print job, and when the same size of the paper sheet is used for the current print job and the subsequent print job, continues the printing without changing the heating width until completion of the print job.

11. An image forming apparatus according to claim 1, further comprising an operation input section for inputting a setting on at least one of the size and a type of the paper sheet used for the printing, wherein the control section recognizes the at least one of the size and the type of the paper sheet used for the printing based on contents input through the operation input section.

12. An image forming apparatus according to claim 11, wherein the control section checks during execution of a current print job whether or not the same size of the paper sheet is used for a subsequent print job, and when the same size of the paper sheet is used for the current print job and the subsequent print job, continues the printing without changing the heating width until completion of the print job.

13. An image forming apparatus, comprising:

a sheet feeding section for receiving a paper sheet used for printing;

an image forming section for forming a toner image;

a heating section comprising a rotary member that is brought into contact with the paper sheet, for fixation of the toner image;

a coil that is opposed to the heating section and is wound around the rotary member in an axis direction thereof, for heating the heating section by induction heating;

a core that is opposed to the heating section, forms a magnetic path between the coil and the heating section, and has a circumferential surface covered with a magnetic shielding plate, the circumferential surface covered with the magnetic shielding plate having different lengths in the axis direction in a plurality of steps according to a position in a circumferential direction;

a rotary section for causing the core to rotate;

a plurality of temperature sensing elements for sensing temperatures of the heating section according to a heating width; and a control section for controlling power to be supplied to the coil based on an output from each of the plurality of temperature sensing elements, recognizing a size of the paper sheet used for the printing, controlling the heating width in the heating section by controlling the rotary section to control a rotation angle of the core, controlling the rotary section to set the heating width corresponding to the size of the paper sheet at a start of a print job, and causing the heating section to be heated by controlling the rotary section to set the heating width wider midway through the end of the print job than at the start of the print job, a storage section for storing data, wherein: the storage section stores measurement data on a temperature rising rate for a non-sheet passing region obtained when the heating section is heated with the heating width widened midway through the print job; and the control section references the measurement data to obtain a rising duration required to raise a temperature of the non-sheet passing region sensed by the each of the plurality of temperature sensing elements to a fixation control temperature being a temperature level necessary for the fixation and a printing duration required to complete the printing of a remaining number of prints of the print job, performs comparison therebetween, and determines a timing to cause the heating section to be heated with the heating width widened midway through the print job during a period in which the rising duration is shorter than the printing duration required to complete the printing of a remaining number of prints of the print job.

14. An image forming apparatus according to claim 13, wherein: the storage section stores a plurality of kinds of the measurement data according to the size of the paper sheet that can be used on the image forming apparatus; and the control section selects the measurement data corresponding to the size of the paper sheet used for the printing from among the plurality of kinds of the measurement data, and uses the selected measurement data to determine the timing to cause the heating section to be heated with the heating width widened midway through the print job.

15. An image forming apparatus according to claim 14, wherein: the storage section stores a plurality of kinds of the measurement data according to a type of the paper sheet that can be used on the image forming apparatus; and the control section selects the measurement data corresponding to the type of the paper sheet used for the printing from among the plurality of kinds of the measurement data, and uses the selected measurement data to determine the timing to cause the heating section to be heated with the heating width widened midway through the print job.

16. An image forming apparatus according to claim 13, wherein: the storage section stores a plurality of kinds of the measurement data according to a type of the paper sheet that can be used on the image forming apparatus; and the control section selects the measurement data corresponding to the type of the paper sheet used for the printing from among the plurality of kinds of the measurement data, and uses the selected measurement data to determine the timing to cause the heating section to be heated with the heating width widened midway through the print job.

17. An image forming apparatus according to claim 13, wherein the control section is configured to: measure the temperature by using the each of the plurality of temperature sensing elements for sensing the temperature of the non-sheet passing region each time the printing of one page is completed; perform prediction computation for the temperature of the non-sheet passing region at completion of the printing of a subsequent page; compute the rising duration required to raise the temperature of the non-sheet passing region at the completion of the printing of the subsequent page which has been obtained by the prediction computation to the fixation control temperature; further compute the printing duration at the completion of the printing of the subsequent page by multiplying a remaining number of prints at the completion of the printing of the subsequent page by time data; and when the rising duration at the completion of the printing of the subsequent page becomes longer than the printing duration at the completion of the printing of the subsequent page, judge that the heating width is to be widened.

18. An image forming apparatus according to claim 13, wherein the control section sets the heating width corresponding to the size of the paper sheet at the start of the print job so as to leave a widest non-sheet passing region, which is a region of the heating section not in contact with the paper sheet during the fixation, and in a case where the heating section is heated with the heating width widened midway through the print job, causes the heating section to be heated so that a temperature of the non-sheet passing region reaches a fixation control temperature, which is a temperature level necessary for the fixation a sheet, by a time of completion of the print job.

19. An image forming apparatus according to claim 13, wherein the control section causes the heating section to be heated with the heating width widened to the heating width corresponding to the paper sheet having a largest size among the paper sheets received in the sheet feeding section in a case where the heating section is heated midway through the print job with the heating width set wider than at the start of the print job.

20. An image forming apparatus according to claim 13, wherein the control section causes the heating section to be heated with the heating width widened to the heating width corresponding to the size of the paper sheet used for a subsequent print job in a case where the heating section is heated midway through the print job with the heating width set wider than at the start of the print job.

* * * * *